United States Patent [19]

O'Connor et al.

[11] Patent Number: 5,066,572

[45] Date of Patent: Nov. 19, 1991

[54] CONTROL OF PRESSURE-FOG WITH GELATIN-GRAFTED AND CASE-HARDENED GELATIN-GRAFTED SOFT POLYMER LATEX PARTICLES

[75] Inventors: Kevin M. O'Connor, Webster; Richard P. Szajewski, Rochester; Pranab Bagchi, Webster, all of N.Y.

[73] Assignee: Eastman Kodak Company, Rochester, N.Y.

[21] Appl. No.: 497,456

[22] Filed: Mar. 22, 1990

[51] Int. Cl.[5] ..... G03C 1/46

[52] U.S. Cl. ..... 430/503; 430/531; 430/537; 430/539; 430/627; 430/628; 430/950; 430/961

[58] Field of Search ..... 430/627, 628, 961, 950, 430/531, 537, 539, 503

[56] References Cited

U.S. PATENT DOCUMENTS

| | | | |
|---|---|---|---|
| T969,005 | 4/1978 | Tanaka et al. . | |
| 3,576,628 | 4/1971 | Beavers . | |
| 4,499,179 | 2/1985 | Ota et al. . | |
| 4,614,708 | 9/1986 | Timmerman et al. | 430/627 |
| 4,714;671 | 12/1987 | Helling et al. | 430/627 |
| 4,822,727 | 4/1989 | Ishigaki et al. | 430/537 |
| 4,840,881 | 6/1989 | Watanabe et al. . | |
| 4,855,219 | 8/1989 | Bagchi et al. | 430/627 |
| 4,920,004 | 4/1990 | Bagchi | 430/950 |
| 4,940,653 | 7/1990 | Lalvani et al. | 430/950 |

FOREIGN PATENT DOCUMENTS

| | | | |
|---|---|---|---|
| 0307855 | 9/1988 | European Pat. Off. . | |
| 0307856 | 9/9188 | European Pat. Off. . | |
| 0223264 | 6/1985 | Fed. Rep. of Germany | 430/627 |

OTHER PUBLICATIONS

Curme et al., J. Phys. Chem., 1964, pp. 3009-3016.
Dautrick et al., J. Photogr. Sci., 1973, pp. 221-226.
Farnell et al., J. Photogr, Sci., 1982 pp. 109-117.

*Primary Examiner*—Charles L. Bowers, Jr.
*Assistant Examiner*—Thomas R. Neville
*Attorney, Agent, or Firm*—Paul A. Leipold

[57] ABSTRACT

This invention describes a substantially less pressure sensitive photographic film comprising a support, at least one light sensitive silver halide element, and an overlaying element comprising gelatin-grafted or case-hardened gelatin-grafted soft polymer particle composite element. The incorporation of such an overlaying composite particle cushioning layer does not compromise either the physical properties or physical integrity of the film unit. This invention is particularly suitable for highly pressure sensitive tabular grain emulsions.

31 Claims, 4 Drawing Sheets

CONTROL OF PRESSURE-FOG WITH GELATIN-GRAFTED AND CASE-HARDENED GELATIN-GRAFTED SOFT POLYMER LATEX PARTICLES

TECHNICAL FIELD

This invention relates to the use of gelatin grafted or case-hardened gelatin-grafted soft (glass transition temperature, Tg, less than about 20° C.) polymer particles, coated in a cushioning layer between the gelatin overcoat layer and the sensitized photographic layers of a full color multilayer film pack of a photographic product comprising highly pressure sensitive tabular emulsion grains for drastic reduction of effects of pressure on the sensitometric behavior of the said photographic film product.

BACKGROUND ART

The following publications may be considered related technology to this invention:

R-1: T. H. James, "The Theory of the Photographic Processes," 4th Edition, MacMillan (1977).

R-2: R. Doubendiek et al, "Multicolor Photographic Element With a Tabular Grain Emulsion Layer Overlaying a Minus Blue Recording Emulsion Layer," U.S. Pat. No. 4,693,964 issued to Eastman Kodak Company on Sept. 15, 1987.

R-3: Anonymous, "Photographic Silver Halide Emulsions, Preparations, Addenda, Processing and Systems," *Research Disclosure,* 308, p. 933-1015 (1989).

R-4: D. J. Beavers, "Photographic Diffusion Transfer Process," U.S. Pat. No. 3,576,628 issued to Eastman Kodak Company on Apr. 27, 1971.

R-5: Ishigaki et al, "Silver Halide Photographic Light Sensitive Material," U.S. Pat. No. 4,822,727 issued to Fuji Photo Film Co., Ltd., on Apr. 18, 1989.

R-6: Y. Watanabe et al, "Process for the Production of Light-Sensitive Silver Halide Photographic Material," U.S. Pat. No. 4,840,881 issued to Konishiroku Photo Industry Co., Ltd. on June 20, 1989.

R-7: A. Tanaka et al, "Color Photographic Materials Containing High-Boiling Organic Solvent," U.S. Defensive Publication T969,005 issued on Apr. 4, 1978.

R-8: H. Ota et al, "Silver Halide Photographic Light-Sensitive Material," U.S. Pat. No. 4,499,179 issued to Konishiroku Photo Industry Co., Ltd. on Feb. 12, 1985.

R-9: P. Bagchi et al, "Photographic Element Having Polymer Particles Covalently Bonded to Gelatin," U.S. Pat. No. 4,855,219 issued to Eastman Kodak Company on Aug. 8, 1989.

R-10: P. Bagchi et al, "Photographic Element Having Polymer Particles Covalently Bonded to Gelatin," European Patent Application 0 307 856, priority date Sept. 18, 1987, corresponding to R-9.

R-11: P. Bagchi, "Gelatin-Grafted Polymer Particles," U.S. application Ser. No. 307,393 allowed Dec., 1989.

R-12 P Bagchi, "Gelatin Grafted Polymer Particles," European Patent Application No. 0 037 855, priority date Sept. 18, 1987 corresponding to R-11.

R-13: P. Bagchi, "Theory of Stabilization of Colloidal Particles by Nonionic Polymers," *J. Colloid and Interface Science,* 47, 86 (1974).

R-14: P. Bagchi, "Nonionic Denting and Mixing Potentials Between Two Flat Plates," *J. Colloid and Interface Science,* 47, 100 (1974).

R-15: D. S. Gibbs et al, "Structured Particle-Latexes," U.S. Pat. No. 4,017,442 issued to the Dow Chemical Company on Apr. 12, 1977.

R-16: G. A. Campbell, "Crosslinkable Polymers Having Vinylsulfone Groups or Styrylsulfonyl Groups and Their Use as Hardeners for Gelatin," U.S. Pat. No. 4,161,407 issued to Eastman Kodak Company on July 17, 1979.

R-17; M. Oganer et al, "Element for Electrophonics," U.S. Pat. No. 4,548,870 issued to Fuji Photo Film Co., Ltd., on Oct. 22, 1985.

R-18: H. L. Cohen et al, "Polymeric Mordants and Elements Containing Same," U.S. Pat. No. 3,625,694 issued to Eastman Kodak Company on Dec. 7, 1971.

R-19: L. M. Minsk et al, "Polymeric Hardeners Containing Aziridinyl Units on the Side Chain," U.S. Pat. No. 3,671,256 issued to Eastman Kodak Company on June 20, 1972.

R-20: H. Jung et al, "Process for the Chain-Lengthening of Gelatin by Partial Hardening," U.S. Pat. No. 4,421,847 issued to Agfa-Gevaert on Dec. 20, 1983.

R-21: J. Herzog, "Diphenyl harnstoffchlorid als Reagens Für Phenole," *Chem. Ber.* 40, 1831 (1907).

R-22: W. Himmelman, "Hardening With a Heterocyclic Carbamoyl Ammonium Compound of a Photographic Material Containing a Silver Halide Layer," U.S. Pat. No. 3,880,665 issued to Agfa-Gevaert on Apr. 29, 1975, and German Application 2,225,230 dated May 24, 1972.

R-23: W. Himmelman, "Hardening With a Heterocyclic Carbamoyl Ammonium Compound of a Photographic Material Containing a Silver Halide Layer," U.S. Pat. No. 3,880,665 issued to Agfa-Gevaert on Apr. 29, 1975, and German Application 2,317,677 dated Apr. 7, 1973.

R-24: W. Himmelman et al, "Process for Hardening Silver Halide Containing Photographic Layer With Sulpho or Sulphoalkyl Substituted Carbomoyl Peridinium Compounds," U.S. Pat. No. 4,063,952 issued to Agfa-Gevaert on Dec. 20, 1977, and German Application 2,439,551 dated Aug. 17, 1974.

R-25: P. J. Stang et al, "Dication Ether Salts $R^+—O—R^+—2CF_3SO_3^-$, from the Reaction of Trifluoro-methane Sulfonic Anhydride With Activated Ketones," *J. Am. Chem. Soc.,* 103, 4837 (1981).

R-26: D. S. Morehouse et al, "Expandable Thermoplastic Polymer Particles Containing Volatile Fluid Foaming Agent and Method of Foaming the Same," U.S. Pat. No. 3,615,972 issued to the Dow Chemical Company on Oct. 26, 1971.

R-27: W. R. Sorenson et al, "*Preparative Methods of Polymer Chemistry,*" 2nd Edition, Wiley (1986), N.Y.

R-28: M. P. Stevens, "*Polymer Chemistry—An Introduction,*" Addison Wesley (1975), London.

R-29: H. G. Curme et al, "The Adsorption of Gelatin to a Silver Bromide Sol," *J. Phys. Chem.* 68, 3009 (1964).

Pressure applied to photographic emulsion coatings can produce both reversible and irreversible effects on the sensitometry of the photographic product. Sufficient pressure can cause irreversible distortion of the emulsion grains or cause the formation of physical defects that alter the sensitivity for latent image formation. It has been generally recognized (R-1) that effect of pressure on the sensitivity of photographic products increases with the magnitude of the applied pressure.

Various types of pressure effects on silver halide photographic systems have been known for long periods of time. In general, pressure sensitivity can be described as an effect which causes the photographic sensitometry of film products to change after the application of some kind of a mechanical stress to a coated photographic film.

The cited prior ar& (R-1) describe various mechanisms in association with &he various types of pressure sensitivities observed with photographic products. However, it is clear that the change in sensitometry is caused by the transmission of mechanical and thermal stress to the silver halide crystals.

In photographic systems, pressure sensitivity, as described, in this general term produces considerable quality defects of products that manifest as increased or decreased density marks on them after development. Such stress may be received from transport mechanism in cameras or other exposing devices or possibly during processing operations. In general, the pressure sensitivity problem increases with the physical size of the emulsion crystals. Its manifestation is most severe in the high aspect ratio highly deformable "Tabular Grain Emulsions," extensively described in prior art (R-1, R-2, and R-3). There is, therefore, a need to produce photographic coatings that are less sensitive to mechanical stress in order to improve the quality of many of the current photographic products.

Dry gelatin is hard and can thus easily transmit applied stress to the silver halide crystals in a coated photographic system. Prior arts (R-4 and R-5) describe the inclusion of low glass transition temperature, Tg, soft polymer latexes into coated photographic films. (R-4) discloses inclusion of such polymers into the emulsion containing layers, and (R-5) describes incorporation of such polymers into overcoat layers. Similarly, prior art (R-6, R-7, and R-8) describe the use of organic solvent dispersions in photographic layer to reduce the pressure sensitivities of film products. However, in order to reduce the pressure sensitivity of present day high speed and high pressure sensitivity photographic products, the solvent loads of the films have to be so high that such films show signs of delamination in the layers containing the solvent dispersion when pressure is applied for testing. Therefore, it would be desirable to reduce pressure sensitivity of photographic products without inhibiting developability or diminishing the integrity of film product.

DISCLOSURE OF INVENTION

An Object of this invention is to provide articles with improved resistance to defects caused by pressure on the film.

Another object is to provide improved photographic film.

These and other objects of the invention are generally accomplished by providing a soft polymer particle that is covalently bonded to gelatin either directly or with the aid of a cross-linking agent. This material in an alternative form of the invention is then provided with a further quantity of hardener that provides a hardened coating on the surface of the gelatin bonded particle herein referred to as a case-hardened particle. The particles when added to a cushioning layer between a gelatin overcoat and the photosensitive silver halide grain containing layers of a photographic element or to interlayers between photosensitive layers, result in a photographic element having improved resistance to defects caused by pressure being applied to the film either before or after imaging but prior to development.

A BRIEF DESCRIPTION OF THE DRAWINGS

FIG. 1 shows a submicroscopic view of the circular section of a hardened coated layer of gel grafter polymer particles.

FIG. 2 pictorially shows the process of case-hardening.

MODES FOR CARRYING OUT THE INVENTION

Figure 1:
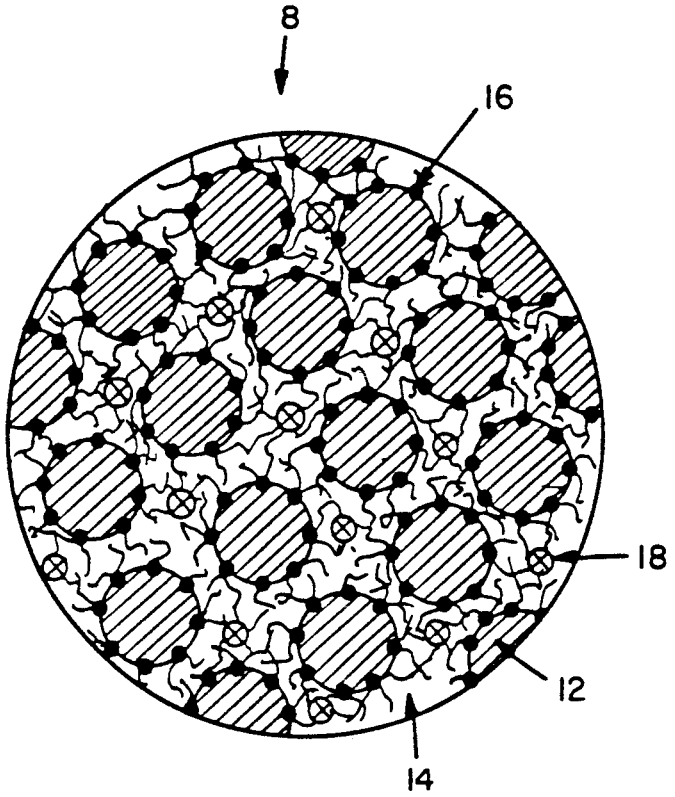

The invention has numerous advantages over prior processes for minimization of pressure fog. The invention photographic layer or layers having the particles of the invention incorporated therein do not have a tendency to delaminate as do high solvent containing pressure resistant materials. Further the particles of the invention do not lead to substantial deterioration in photographic properties. Another advantage is that the particles do not contribute environmentally undesirable materials that will come out during development. These and other advantages will be apparent from the detailed description below.

The polymer particles useful in the invention include polymer particles that are covalently bonded to gelatin either directly or with the aid of a cross-linking agent. The polymers are soft and deformable and preferably have a glass transition temperature of less than 25° C. Suitable materials are those polymer latex particles as described in U.S. Pat. Nos. 4,855,219 (1989) (R-9), European Patent Application EP 0 307 856 (9/18/87) (R-10), and European Patent Application EP 0 307 855A2 (9/18/87) (R-12). Such polymers can be coated or cast into thin films like gelatin. Depending upon the particle size of the latex, these materials can be made with just enough gelatin to cover the surface of the latex particles with very little or no gel left in solution. A preferred ratio of gelatin to the soft polymer particles is between 1 to 2 and 2 to 1. When to such material is added further quantity of hardener, the hardener cross links the gelatin adsorption layer, as there is no free gelatin left in solution. When to such material is added further quantity of hardener, the hardener cross links the gelatin adsorption layer, as there is no free gelatin left in solution. This process may be called case-hardening. Such case-hardened gelatin-grafted soft latex particles in a dry state, as in a coating, will have soft latex particles covered with a chemically bonded highly cross linked hard thin skin around the particles. In this composite particle, &he hard shell, of up to 10 nm in thickness, is highly elastic and the core is soft and highly viscous. A coating of this material will exhibit viscoelastic behavior which means that it will absorb stress by deforming. However, this hardened elastic skin will relax back once stress is released, or in simple words, such composite material will both absorb and resist mechanical stress (as the shock absorbers in an automobile) and will prevent mechanical stress from being transmitted to the silver halide grains and thus produce relief from pressure sensitivity. Since such polymer particles have a chemically bonded layer of gelatin around them, they will be sterically stabilized (R-13 and R-14) from coalesce and thus will not exhibit poor developability as is observed when Just high levels of soft polymer particles are incorporated in a photographic coating. Hardener added in process of coating of a photographic element will cross-link the particles through this gelatin layer surrounding the particles and will thus not reduce the integrity of the film material under stress. Such gelatin grafted and/or gelatin grafted case hardened particles, when coated as a cushioning layer between a gelatin overcoat and the full color multilayer pack in a photographic film, act as a stress absorbing sandwich layer and reduce pressure fog problems associated with high aspect ratio tabular grain emulsion containing film systems. The silver halide element may contain conventional color coupler dispersions prepared with or without coupler solvents. The invention also is suitable for use in films where the coupler is added with the developing solutions.

DESCRIPTION OF GELATIN-GRAFTED SOFT POLYMER PARTICLES

Polymer particles useful in the present invention are those that contain recurring units that are capable of covalently bonding with gelatin directly or with the aid of an activator or a grafting aid.

Monomers from which polymers can be derived that are capable of directly bonding with gelatin through the amine group of gelatin are as follows:

1. Suitable activated halogen-containing monomers include monomers having appended halomethylaryl, halomethylcarbonyl, halomethylsulfonyl, haloethylcarbonyl, and haloethylsulfonyl groups which will, after polymerization, also undergo crosslinking with a suitable crosslinking agent such as a diamine, dithiol, diol, and so forth.

Monomers having halomethylaryl groups, for example, vinylbenzyl chloride, and vinylbenzyl bromide, are disclosed in U.S. Pat. No. 4,017,442 (R-15).

Useful monomers having appended haloethylsulfonyl groups such as m- and p (2 chloroethylsulfonylmethyl)styrene and N-(4 chloroethylsulfonylmethyl phenyl)acrylamide are described in U.S. Pat. Nos. 4,161,407 (R-16) and 4,548,870 (R-17).

Polymers having appended halomethylcarbonyl or haloethylcarbonyl groups such as chloroacetyl and chloropropionyl, are described in U.S. Pat. No. 3,625,694. Monomers which provide such crosslinkable groups include:

vinyl chloroacetate,
N-(3-chloroacetamidopropyl)methacrylamide,
2 chloroacetamidoethyl methacrylate,
4 chloroacetamidostyrene,
m- and p-chloracetamidomethylstyrene,
N-(3-chloroacetamidocarbonyliminopropyl)methacrylamide,2-chloroacetamidocarbonyliminoethyl methacrylate,
4-chloroacetamidocarbonyliminostyrene,
m- and p chloroacetamidocarbonyliminomethylstyrene,
N-vinyl-N'-(3 chloropropionyl)urea,
4 (3 chloropropionamido)styrene,
4 (3 chloropropionamidocarbonylimino)styrene,
2 (3-chloropropionamido)ethyl methacrylate, and
N-[2-(3-chloropropionamido)ethyl]methacrylamide.

2. Another variety of useful active halogen monomer includes those having appended triazinyl groups such as N-[3 (3,5 dichloro-1-triazinylamino) propyl]methacrylamide.

3. Active ester group-containing monomers are disclosed in U.S. Pat. No. 4,548,870 (R-17). Preferred active ester monomers are N-[2-(ethoxycarbonylmethoxycarbonyl)ethyl]acrylamide,
N-(3 methacrylamidopropionyloxy)succinimide,
N-(acryloyloxy)succinimide, and
N-(methacryloyloxy)succinimide.

4. Polymers having appended aldehyde groups as cross-linkable sites are also disclosed in U.S. Pat. No. 3,625,694 (R-18). Monomers providing such groups are p-methacryloyloxybenzaldehyde, vinylbenzaldehyde and acrolein.

5. Monomers having appended aziridine groups such as N-acryloylaziridine, N-(N-vinylcarbamyl)aziri dine, and 2-(1 aziridinyl)ethyl acrylate, as described in U.S. Pat. No. 3,671,256 (R-19).

6. Monomers having appended isocyanates (e.g., isocyanatoethyl acrylate, isocyanatoethyl methacrylate, or $\alpha,\alpha$-dimethylmetaisopropenylbenzyl isocyanate).

Monomers, the polymers, and copolymers of which are capable of covalently bonding with gelatin through the use of a grafting agent, include carboxylic acids (e.g., acrylic acid, methacrylic acid, itaconic acid, and maleic acid or anhydride), amine-containing monomers (e.g., 2-aminoethyl methacrylate and N-(3 aminopropyl)methacrylamide hydrochloride), and active methylene group containing monomers (e.g., 2 acetoacetoxyethyl methacrylate and diacetone acrylamide).

Gelatin grafting agents that can be utilized for the attachment of gelatin to polymer particles having carboxyl groups are as follows:

(1) Carbamoylonium salts are used for covalent attachment of the reactive amine- or sulfhydryl containing compound (gelatin) to the polymeric particles having carbonyl groups in the practice of this invention. These salts are described in some detail in U.S. Pat. No. 4,421,847 (R-20) (issued Dec. 20, 1983 to Jung et al), and are generally represented by the structure:

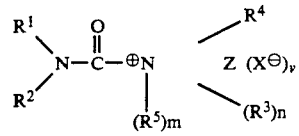

(I)

In structure (I), Z represents the atoms necessary to complete a substituted or unsubstituted 5- or 6-membered heterocyclic aromatic ring including heterocyclic rings having a fused carbocyclic ring (for example, a pyridinium, imidazolium, thiazolium, isoxazolium or quinolinium ring). Preferably, Z represents the atoms necessary to complete a substituted 6 membered heterocyclic aromatic ring.

Further, m and n are independently 0 or 1.

$R^1$ and $R^2$ are, independently of each other, substituted or unsubstituted alkyl (generally of 1 to 6 carbon atoms, for example, methyl, ethyl, isopropyl, or chloromethyl) or substituted or unsubstituted aryl (generally of 6 to 10 carbon atoms, for example, phenyl, p-methylphenyl, m-chlorophenyl, or naphthyl), or substituted or unsubstituted aralkyl (generally of 7 to 12 carbon atoms, for example, benzyl or phenethyl which can be substituted in the same manner as the aryl group).

Alternatively, $R^1$ and $R^2$ together represent the atoms necessary to complete a piperidine, piperazine, or morpholine ring, which ring can be substituted, for example, with one or more alkyl groups each having 1 to 3 carbon atoms or by a halo atom.

$R_3$ is a hydrogen atom, a substituted or unsubstituted alkyl as defined above for $R^1$, or the $\vdash A]$ wherein A represents the polymerized vinyl backbone of a homo- or copolymer formed from one or more ethylenically unsaturated polymerizable compounds such &hat the molecular weight of the homo or copolymer is greater than about 1000. Useful ethylenically unsaturated polymerizable compounds are known to one of ordinary skill in the polymer chemistry art. The polymer [A]can comprise additional moieties derived from the compounds represented by structure (I). $R^4$ is a hydrogen atom, a substituted or unsubstituted alkyl (as defined above for $R^1$), or when Z represents the atoms necessary to complete a pyridinium ring and n is 0, $R^4$ is selected from the following groups:

(a) $—NR^6—CO—R^7$ wherein $R^6$ is hydrogen or substituted or unsubstituted alkyl (generally of 1 to 4 carbon atoms, for example, methyl, ethyl, n butyl, chloromethyl, $R^7$ is hydrogen, substituted or unsubstituted alkyl (as defined above for $R^6$) or $—NR^8R^9$ wherein $R^8$ and $R^9$ are, independently of each other, hydrogen or substituted or unsubstituted alkyl (as defined above for $R^6$.

(b) $—(CH_2)_1—NR^{10}R^{11}$ wherein $R^{10}$ is $—CO—R^{12}$, $R^{11}$ is hydrogen or substituted or unsubstituted alkyl (as defined above for $R^6$), $R^{12}$ is hydrogen, substituted or unsubstituted alkyl (as defined above for $R^6$) or $—NR^{13}R^{14}$ wherein $R^{13}$ is substituted or unsubstituted alkyl (as defined above for $R^6$) or substituted or unsubstituted aryl (as defined above for $R^1$), $R^{14}$ is hydrogen, substituted or unsubstituted alkyl (as defined above for $R^6$) or substituted or unsubstituted aryl (as defined for $R^1$), and q is an integer from 1 to 3, (c) $—(CH_2)_r—CONR^{15}R^{16}$ wherein $R^{15}$ is hydrogen, substituted or unsubstituted alkyl (as defined above for $R^6$) or substituted or unsubstituted aryl (as defined above for $R^1$), $R^{16}$ is hydrogen or substituted or unsubstituted alkyl (as defined above for $R^6$), or $R^{15}$ and $R^{16}$ together represent the atoms necessary to complete a 5- or 6-membered aliphatic ring, and r is 0 or an integer from 1 to 3, (d) $\vdash CH_2\dashv_t—CH(Y)—R^{17}$, $Y—R^{18}$ wherein $R^{17}$ is hydrogen, substituted or unsubstituted alkyl (as defined above for $R^6$), Y is oxy or $—NR^{19}—$, $R^{18}$ is hydrogen, substituted or unsubstituted alkyl (as defined above for $R^6$), $—CO—R^{20}$, or $—CO—NHR^{21}$ wherein $R^{19}$, $R^{20}$ and $R^{21}$ are, independently of each other, hydrogen or substituted or unsubstituted alkyl (as defined above for $R^6$), and t is 2 or 3, and (e) $—R^{21}X'^{\ominus}$wherein $R^{21}$ is substituted or unsubstituted alkylene of from 1 to 6 carbon atoms (for example, methylene, trimethylene or isopropylene), and $X'^{\ominus}$is a covalently bonded anionic group such as sulfonate or carboxylate so as to form an inner salt group with the pyridinium nucleus. $R^5$ is substituted or unsubstituted alkyl (as defined above for $R^6$), substituted or unsubstituted aryl (as defined above for $R^1$) or substituted or unsubstituted aralkyl (as defined above for $R^1$), provided that m is 0 when the nitrogen atom to which $R^5$ is bound is attached to the remainder of the ring through a double bond.

$X^{\ominus}$is an anion, such as a halide, tetrafluoroborate, nitrate, sulfate, p-toluenesulfonate, perchlorate, methosulfate or hydroxide, and v is 0 or 1, provided that it is 0 only when $R^4$ is $—R^{21}X'^{\ominus}$.

Preferably, the carbamoylonium compound used in the practice of this invention is represented by the structure above wherein $R^1$ and $R^2$ together represent the atoms necessary to complete a morpholine ring, Z represents the atoms necessary to complete a pyridinium ring, $R^4$ is $—R^{21}X'^{\ominus}$(such as $—CH_2CH_2SO_3^-$, and m, n, and v are each 0.

Representative preferred carbamoylonium compounds include 1 (4-morpholinocarbonyl)-4 (2-sulfoethyl)pyridinium hydroxide, inner salt, and 1 (4-morpholinocarbonyl)pyridinium chloride, most preferably, 1-(4-morpholinocarbonyl) 4 (2-sulfoethyl)pyridinium hydroxide, inner salt.

The carbamoylonium compounds useful in the practice of this invention can be obtained commercially, or prepared using known procedures and starting materials, such as described in U.S. Pat. No. 4,421,847 (noted above) (R-20), and references noted therein, incorporated herein by reference. Some examples of such compounds are listed in Table I.

TABLE I

Carbamoylonium Gelatin-Grafting Agents

| | Carbamoylonium Compound Number |
|---|---|
| 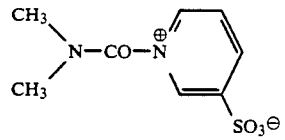 | 1 |
| 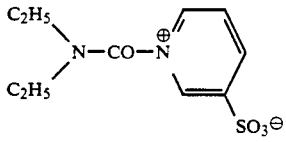 | 2 |

TABLE I-continued
Carbamoylonium Gelatin-Grafting Agents
| | Carbamoylonium Compound Number |
|---|---|
| 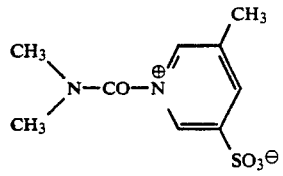 | 3 |
| 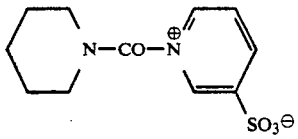 | 4 |
| 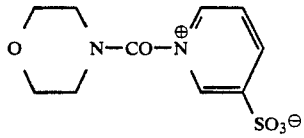 | 5 |
| 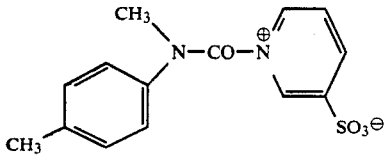 | 6 |
| 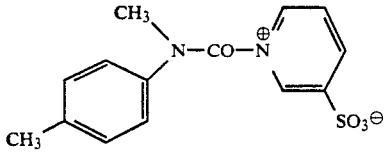 | 7 |
| 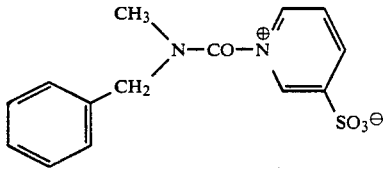 | 8 |
| 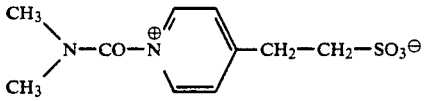 | 9 |
| 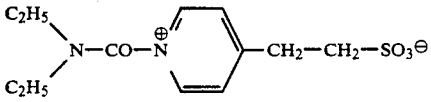 | 10 |
| 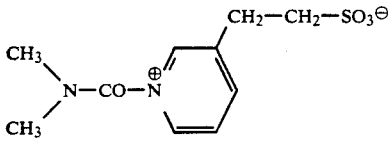 | 11 |

TABLE I-continued
| Carbamoylonium Gelatin-Grafting Agents | Carbamoylonium Compound Number |
|---|---|
| 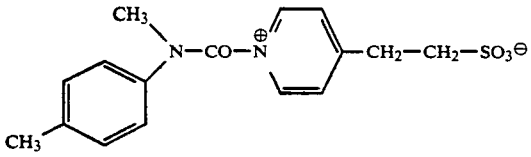 | 12 |
| 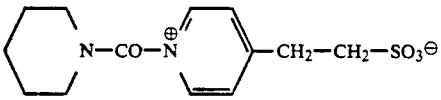 | 13 |
| 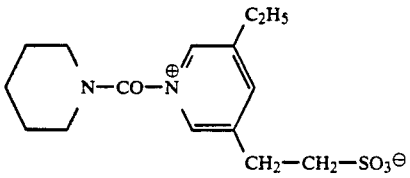 | 14 |
| 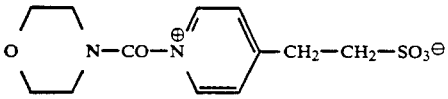 | 15 |
| 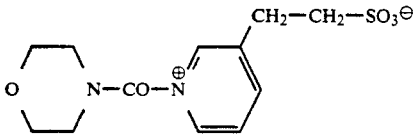 | 16 |
| 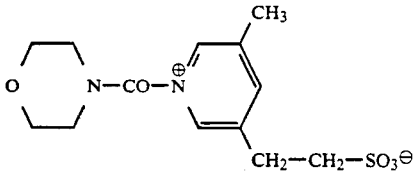 | 17 |
| 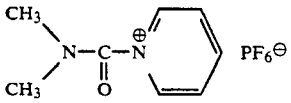 | 18 |
| 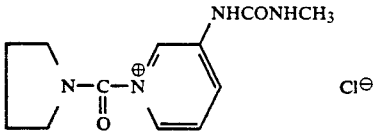 | 19 |
| 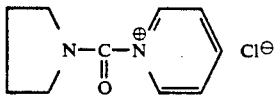 | 20 |
| 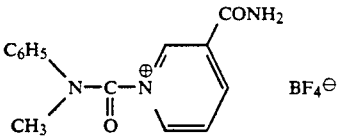 | 21 |

TABLE I-continued

| Carbamoylonium Gelatin-Grafting Agents | Carbamoylonium Compound Number |
|---|---|
| 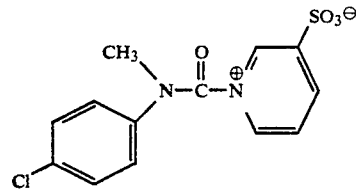 | 22 |
| 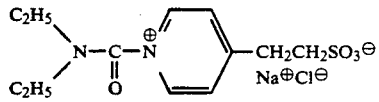 | 23 |
| 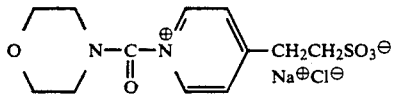 | 24 |
| 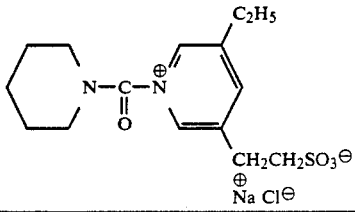 | 25 |

The above compounds can be synthesized readily by literature methods. Carbamic acid chlorides are synthesized from secondary amines with, for example, phosgene, and are then reacted in the dark with aromatic heterocyclic nitrogen containing compounds. The synthesis of compound 3 has been described in Chem. Ber., 40, p. 1831 (1907) (R-21). Other synthetic methods can be found in the German patent applications 2,225,230 (R-22); 2,317,677 (R-23); and 2,439,551 (R-24).

(2) Dication ethers are also useful as grafting agents for bonding gelatin to a polymer particle containing carboxyl groups.

Useful dication ethers have the formula:

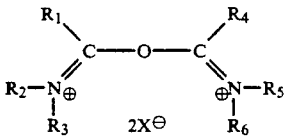

(II)

In this formula, $R_1$ represents hydrogen, alkyl, aralkyl, aryl, alkenyl, $-YR_7$, the group

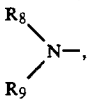

or the group

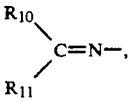

with Y representing sulfur or oxygen, and $R_7$, $R_8$, $R_9$, and $R_{10}$, and $R_{11}$ each independently representing alkyl, alkyl, aralkyl, aryl, or alkenyl. Alternatively, $R_8$ and $R_9$, or $R_{10}$ and $R_{11}$ may together form a ring structure. $R_{10}$ and $R_{11}$ may each also represent hydrogen. Also, $R_1$ together with $R_2$ may form a heterocyclic ring.

$R_2$ and $R_3$ each independently represents alkyl, aralkyl, aryl, or alkenyl, or, combined with $R_1$ or each other, forms a heterocyclic ring.

$R_4$, $R_5$, and $R_6$ are independently defined as are $R_1$, $R_2$, and $R_3$, respectively, and can be the same as or different from $R_1$, $R_2$, and $R_3$.

$X^{\ominus}$represents an anion or an anionic portion of &he compound to form an intramolecular (inner) salt.

Dication ethers of formula (I) are described in further detail below.

Preferably, $R_1$ is hydrogen, alkyl of 1 to 20 carbon atoms (e.g., methyl, ethyl, butyl, 2-ethylhexyl, or dodecyl), aralkyl of from 7 to 20 carbon atoms (e.g., benzyl, phenethyl), aryl of from 6 to 20 carbon atoms (e.g., phenyl, naphthyl), alkenyl of from 2 to 20 carbon atoms (e.g., vinyl, propenyl), the group

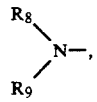

or the group

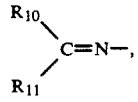

$R_1$ can combine with $R_2$ or $R_3$ to form a heterocyclic ring of 5 to 8 atoms. This ring contains the nitrogen atom to which $R_2$ and $R_3$ are attached in formula (II) and may contain an additional nitrogen atom, or an oxygen or sulfur atom. Examples of such rings include pyridine, quinoline, isoquinoline, thiazole, benzothiazole, thiazoline, oxazole, benzoxazole, imidazole, benzimidazole, and oxazoline.

$R_7$, $R_8$, $R_9$, $R_{10}$, and $R_{11}$ are preferably alkyl of 1 to 20 carbon atoms (e.g., methyl, ethyl, butyl, 2-ethylhexyl, or dodecyl), aralkyl of from 7 to 20 carbon atoms (e.g., benzyl, phenethyl), aryl of from 6 to 20 carbon atoms (e.g., phenyl, naphthyl), or alkenyl of from 2 to 20 carbon atoms (e.g., vinyl, propenyl).

$R_8$ and $R_9$, or $R_{10}$ and $R_{11}$ can also combine to form a ring structure of 5 to 8 atoms. The $R_8$–$R_9$ ring contains the nitrogen atom to which $R_8$ and $R_9$ are attached, and may also contain an additional nitrogen atom, or an oxygen or sulfur atom. The $R_{10}$–$R_{11}$ ring may also contain one or more nitrogen atoms, an oxygen atom, a sulfur atom, or any combination thereof. Examples of such rings include pyrrolidine, piperidine, and morpholine. Preferably, $R_2$ and $R_3$ may each be alkyl of 1 to 20 carbon atoms (e.g., methyl, ethyl, butyl, 2 ethylhexyl, or dodecyl), aralkyl of from 7 to 20 carbon atoms (e.g., benzyl, phenethyl), aryl of from 6 to 20 carbon atoms (e.g., phenyl, naphthyl), or alkenyl of from 2 to 20 carbon atoms (e.g., vinyl, propenyl). $R_2$ and $R_3$ also preferably combine with each other to form a heterocyclic ring of 5 to 8 atoms. This ring contains the nitrogen atom to which $R_2$ and $R_3$ are attached, and may also contain an additional nitrogen atom, or an oxygen or sulfur atom. Examples of such rings include pyrrolidine, piperidine, and morpholine. Either of $R_2$ or $R_3$ can combine with $R_1$ to form a heterocyclic ring, as described above in reference to $R_1$.

$X^{\oplus}$may be any anion that forms a salt compound according to formula (II) that is useful to form biological and diagnostic reagents according to the invention. Preferred anions include a sulfonate ion such as methylsulfonate or p-toluenesulfonate, $CF_3SO_3^{\oplus}$, $BF_4^{\oplus}$, $PF_6^{\oplus}$, and $C10_4^{\oplus}$.

In addition to the above described alkyl, aralkyl, aryl, alkenyl, and heterocyclic groups, groups also useful as $R_1$, $R_2$, $R_3$, $R_4$, $R_5$, $R_6$, $R_7$, and $R_8$ include substituted alkyl, aralkyl, aryl, alkenyl, and heterocyclic groups. Useful substituents include halogen, alkoxy of from 1 to 20 carbon atoms, aryloxy of from 6 to 20 carbon atoms, a sulfo group, N,N-disubstituted carbamoyl, N,N-disubstituted sulfamoyl, and other groups known to those skilled in the art that do not prevent the compounds from functioning as reactive intermediates according to the invention.

Examples of compounds of formula (II) are shown below in Table II.

TABLE II

Dication Ether Gelatin-Grafting Agents

| | | Dication Ether Number |
|---|---|---|
| 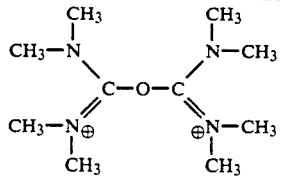 | $2CF_3SO_3^{\ominus}$ | 1 |
| 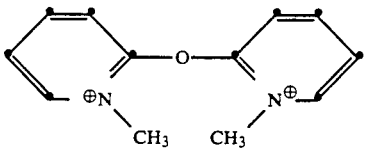 | $2CF_3SO_3^{\ominus}$ | 2 |
| 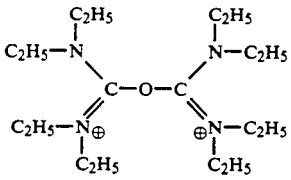 | $2CF_3SO_3^{\ominus}$ | 3 |
| 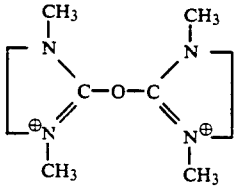 | $2CF_3SO_3^{\ominus}$ | 4 |
| 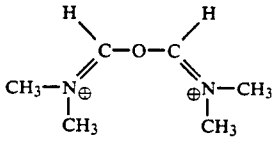 | $2CF_3SO_3^{\ominus}$ | 5 |

TABLE II-continued
| Dication Ether Gelatin-Grafting Agents | | Dication Ether Number |
|---|---|---|
| 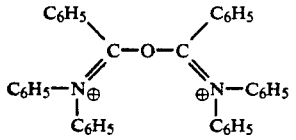 | $2BF_4^{\ominus}$ | 6 |
| 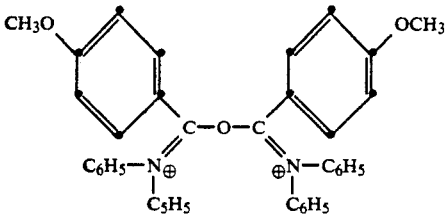 | $2PF_6^{\ominus}$ | 7 |
| 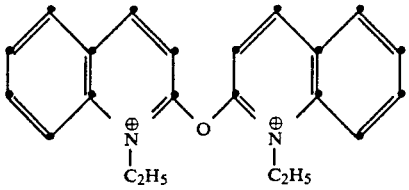 | $2CH_3SO_3^{\ominus}$ | 8 |
| 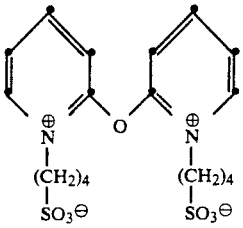 | | 9 |
| 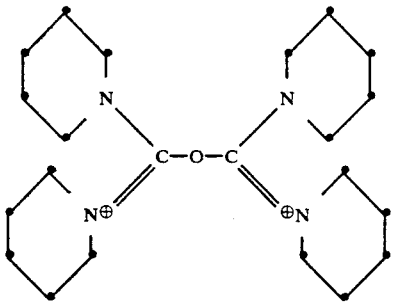 | $2CF_3SO_3^{\ominus}$ | 10 |
| 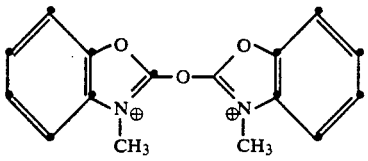 | $2CF_3SO_3^{\ominus}$ | 11 |
| 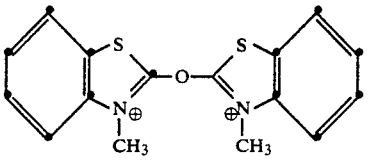 | $2CF_3SO_3^{\ominus}$ | 12 |

TABLE II-continued
Dication Ether Gelatin-Grafting Agents
| | | Dication Ether Number |
|---|---|---|
| 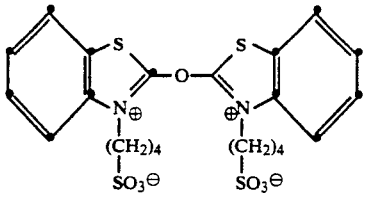 | | 13 |
| 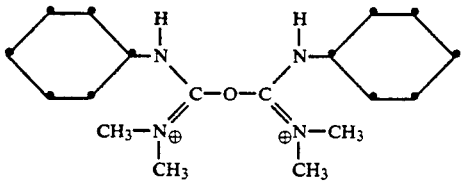 | $2CF_3SO_3^{\ominus}$ | 14 |
| 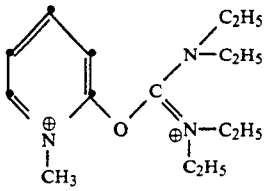 | $2CF_3SO_3^{\ominus}$ | 15 |
| 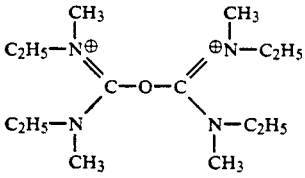 | $2CF_3SO_3^{\ominus}$ | 16 |
| 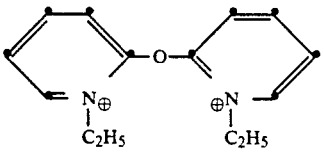 | $2CF_3SO_3^{\ominus}$ | 17 |
| 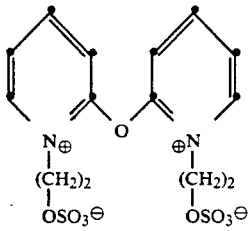 | | 18 |
| 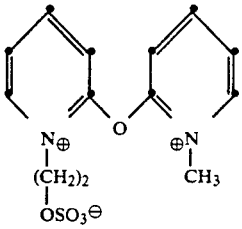 | $CF_3SO_3^{\ominus}$ | 19 |

TABLE II-continued
Dication Ether Gelatin-Grafting Agents
| | | Dication Ether Number |
|---|---|---|
| 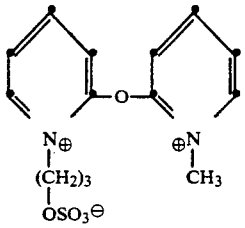 | $BF_4^{\ominus}$ | 20 |
| 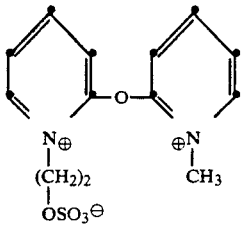 | $PF_6^{\ominus}$ | 21 |
| 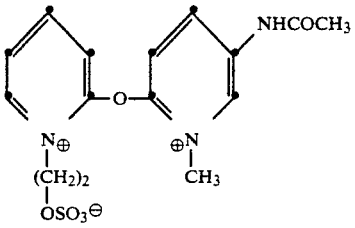 | $CF_3SO_3^{\ominus}$ | 22 |
| 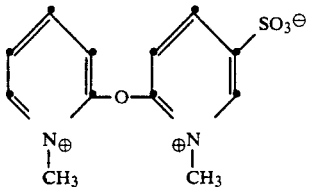 | $CF_3SO_3^{\ominus}$ | 23 |
| 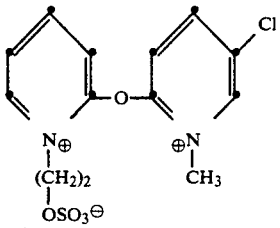 | $CF_3SO_3^{\ominus}$ | 24 |
| 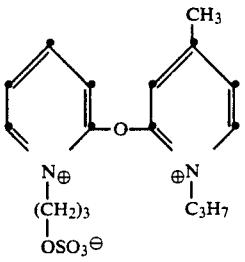 | $BF_4^{\ominus}$ | 25 |

TABLE II-continued
Dication Ether Gelatin-Grafting Agents
| | | Dication Ether Number |
|---|---|---|
| 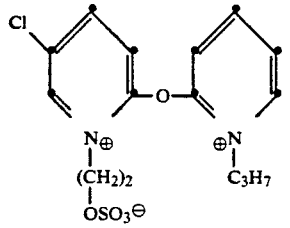 | $BF_4^{\ominus}$ | 26 |
| 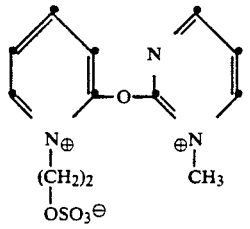 | $CF_3SO_3^{\ominus}$ | 27 |
| 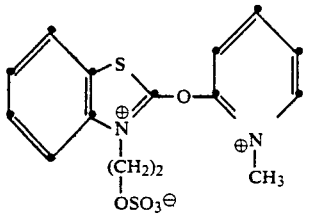 | $CF_3SO_3^{\ominus}$ | 28 |
| 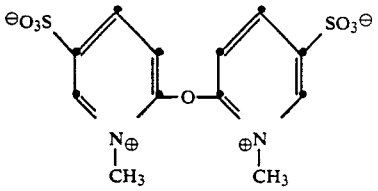 | | 29 |
| 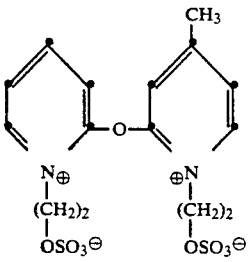 | | 30 |
| 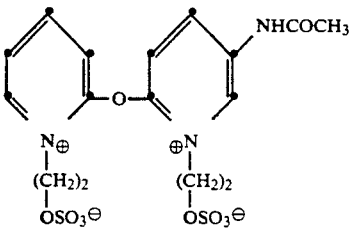 | | 31 |

TABLE II-continued

Dication Ether Gelatin-Grafting Agents

| | | Dication Ether Number |
|---|---|---|
| 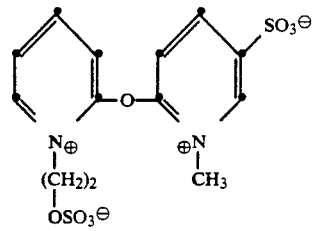 | | 32 |
| 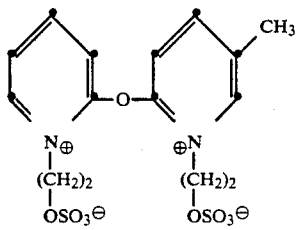 | | 33 |
| 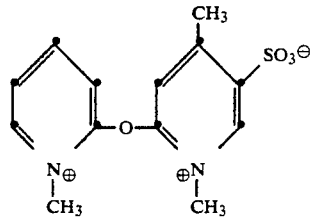 | $BF_4^{\ominus}$ | 34 |
| 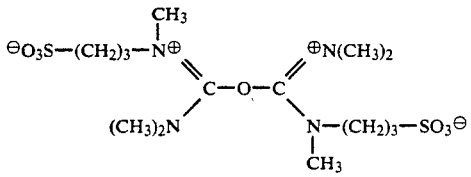 | | 35 |
| 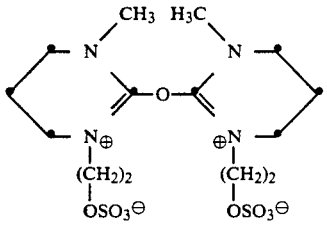 | | 36 |
| 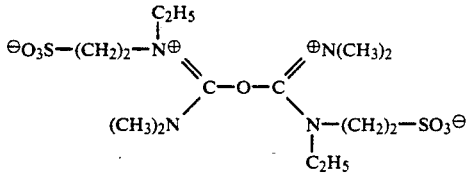 | | 37 |

The ethers of formula (II) can be made by techniques known to those skilled in the chemical synthesis art. Useful synthesis techniques include those described in *Journal of American Chemical Society,* 103, 4839 (1981) (R-25).

(3) Carbodiimides can also be used to attach gelatin to carboxylated latex particles.

Particularly preferred carbodiimide coupling agents are water-soluble carbodiimides of the formula:

$$R_{12}—N=C=N—R_{13}$$

wherein each of $R_{12}$ or $R_{13}$ is selected from: cycloalkyl having from 5 to 6 carbon atoms in the ring., alkyl of from 1 to 12 carbon atoms e.g., methyl, ethyl, n-propyl, isopropyl, n butyl, sec.-butyl, isobutyl, tert, butyl, amyl, hexyl, heptyl, octyl, nonyl, undecyl and dodecyl; monoarylsubstituted lower alkyl radicals, e.g., benzyl-$\alpha$- and $\beta$-phenylethyl; monoaryl radicals, e.g., phenyl; morpholino; piperidyl; morpholinyl substituted with lower alkyl radicals, e.g., ethylmorpholinyl; piperidyl substituted with lower alkyl radicals, e.g., ethylpiperidyl; di-lower alkylamino; pyridyl substituted with lower alkyl radicals, e.g., $\alpha$, $\beta$, and $\gamma$ methyl- or ethylpyridyl; acid addition salts; and quaternary amines thereof.

Polymers useful in the invention preferably comprise at least 0.1 mole percent and more preferably at least 1 mole percent of monomers, the polymers or copolymers of which are capable of covalently bonding with gelatin, either directly or with &he aid of a grafting agent.

In one embodiment of the invention, the polymer useful in the present invention is represented by the formula;

$$(A)_x(B)_{100-x} \quad \text{(IV)}$$

wherein A represents recurring units derived from one or more of the monomers described above that are capable of covalently bonding with gelatin, and B represents recurring units derived from one or more other ethylenically unsaturated monomers.

Monomers represented by B include essentially any monomer capable of copolymerizing with the abovedescribed monomers without rendering them incapable of covalently bonding with gelatin. Examples of such monomers include ethylenically unsaturated monomers such as styrene and styrene derivatives (e.g., vinyltoluene, divinylbenzene, and 4-t-butylstyrene), and acrylic and methacrylic acid esters (e.g., methyl methacrylate, methyl acrylate, ethyl methacrylate, n-butyl acrylate, 2-ethylhexyl methacrylate, 2-hydroxyethyl methacrylate, 2 hydroxyethyl acrylate, ethylene dimethacrylate, methacrylamide, and acrylonitrile). Preferred particles comprise butyl acrylate, ethyl acrylate, 2 ethylhexyl acrylate or propyl acrylate in weight percent from 40 to 98 percent of the total polymer. Among the comonomers B, it is preferred that there be incorporated sufficient monomers which impart a low glass transition temperature (Tg) to the polymer. By low Tg is meant below about 20° C., preferably below about 10° C. Typical monomers which contribute to low Tg's are butyl acrylate, propyl acrylate, 2 ethylhexyl methacrylate and lauryl methacrylate. The amounts of such monomers can be up to about 98%. In such a copolymer, the amount of comonomer that is capable of covalently bonding with gelatin should be sufficient to bind a contiguous layer of gelatin to the surface of the polymer particle.

In the above formula, x represents from 0.1 to 100 mole percent and preferably from 1 to 20 mole percent.

Polymer particles used in the present invention can be any size or shape depending on the use for which they are intended. The core polymer particles can have a mean diameter of from about 10 to $10^4$ nm and, preferably from about 10 to 500 nm and most preferably between about 10 nm and 200 nm for best granularity and developability. Mean diameter of a particle is defined as that measured by photon correlation spectroscopy.

The gelatin to be covalently bound to the polymer particles can be any of the known types of gelatin. These include, for example, alkali-treated gelatin (cattle bone or hide gelatin), acid-treated gelatin (pigskin or bone gelatin), and gelatin derivatives such as partially phthalated gelatin, acetylated gelatin, and the like, preferably the deionized gelatins. The gelatin covalently bound to the polymer particles may be cross-linked through the use of a conventional cross-linking agent. The gelatin layer on the polymer particles is preferably on &he order of the thickness of one gelatin molecule. The actual thickness of the gelatin layer will depend on factors such as the molecular weight of the gelatin, the pH and the size of the particle, and is generally from about 10 to 60 nm and preferably from about 10 to 40 nm.

The polymer particles can be prepared by techniques well-known in the art, such as by polymerization followed by grinding or milling to obtain the desired particle size, or more preferably by emulsion or suspension polymerization procedures whereby the desired particle size can be produced directly as stable dispersions. Emulsion polymerization techniques can be employed to produce particle sizes ranging from about 10 to 5000 nm (preferably about 20 to 1000 nm) as stable aqueous dispersions that can be coated directly without isolation. Larger size particles, i.e., over about 3 $\mu$m are preferably prepared by suspension polymerization, often in an organic solvent system from which the particles are isolated and resuspended in water for most economic coating procedures, or most preferably by "limited coalescence" procedures taught by U.S. Pat. No. 3,615,972 (R-26). The bulk, emulsion, and suspension polymerization procedures are well known to those skilled in the polymer art and are taught in such text books as W. R. Sorenson and T. W. Campbell, *Preparative Methods of Polymer Chemistry* 2nd ed., Wiley (1968), New York (R-27) and M. P. Stevens, *Polymer Chemistry—An Introduction,* Addison Wesley Publishing Co., London (1975) (R-28).

The polymer particles, if the polymer is of the type as described above that is capable of bonding directly with gelatin, may be covalently bonded wi&h gelatin simply by contacting the particles with gelatin under conditions as described below. If the polymer is of the type that utilized a grafting agent to bond with gelatin, the polymer particles are preferably first contacted with the grafting agent and then with gelatin, so that the gelatin preferentially reacts with the polymer particles, instead of gelatin-gelatin cross linking. Carbamoylpyridinium and dication ether grafting agents are advantageously utilized in the practice of this invention because they tend to first bond to a carboxyl group on a polymer particle and then with an amino group on the gelatin molecule. In a preferred form of the invention the soft polymer core contains at least 0.1 mole percent of a monomer with at least one pendent carboxylic acid group or 1 mole percent of methacrylic acid monomer.

The contacting of the polymer particles and gelatin is preferably performed in an aqueous dispersion of the particles. The concentration of polymer particles in the aqueous dispersion is preferably less than about 25% and more preferably less than about 15% by weight. The concentration of gelatin in the aqueous dispersion is preferably less than about 25% and more preferably less than about 15% by weight.

The pH of the aqueous dispersion and the concentration of the particles and gelatin should be adjusted to prevent bridging of gelatin molecules between polymer particles, or coagulation. The pH of the gelatin is preferably maintained above the isoelectric pH of the gelatin (e.g., above 4.8 and preferably between 8 and 10 for lime processed bone gelatin). Under such conditions, both the particles and the gelatin should have the same charge, preferably negative, in order to minimize coagulation.

A particularly preferred embodiment of the material of this invention is a particulate carboxylated polymer wherein repeating unit B is derived from a monomer that causes the polymer to have a low glass transition temperature, for example, butyl acrylate, propyl acrylate, ethyl acrylate, ethylhexyl acrylate, and repeating unit A is derived from a monomer having a pendant acid group such as methacrylic acid. The composition of this copolymer is preferably such that x is between 0.1 to 20 mole percent. The grafting reaction of gelatin to polymers is carried out at a ratio between 10 part gelatin to 1 part polymer latex and 1 part gelatin to 10 parts polymer latex, preferably between 2 parts gelatin to 1 part polymer and 1 part gelatin to 2 parts polymer. The grafting agents utilized are preferably either carbamoylonium compounds or dication ethers. Particularly preferred are the carbamoylonium compounds 13 through 17 of Table I or suitable salts thereof. It is preferred for this invention that the gelatin-grafted polymer material be washed extensively either by dialysis or diafiltration to remove traces of reaction by products and low molecular weight species.

Films of such gelatin-grafted-polymer particle material can be made by conventional coating processes that produce dry films having thicknesses up to about 0.005 cm. Additional conventional gelatin cross linking agents that can be used for preparing wet films are listed in Table III.

TABLE III

Some Conventional Gelatin-Hardening Agents

| | Conventional Gelatin Crosslinking Agents Number |
|---|---|
| $CH_2{=}CH{-}SO_2{-}CH_2{-}SO_2{-}CH{=}CH_2$ | 1 |
| $CH_2{=}CH{-}SO_2{-}CH_2{-}O{-}CH_2{-}SO_2{-}CH{=}CH_2$ | 2 |
| 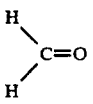 | 3 |
| 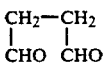 | 4 |
| $CH_2{=}CH{-}CHO$ | 5 |
| $OHC{-}(CH_2)_3{-}CHO$ | 6 |
| $Al_2(SO_4)_3$ | 7 |
| $Cr_2(SO_4)_3$ | 8 |

Conventional hardeners Nos. 1, 2, and 6 are most preferred. Such gelatin grafted polymer films can swell to weights containing 90% water. Gelatin-grafted polymer particles made of low glass transition temperature (Tg) (less than 25° C.) polymer particles having diameters less than 100 nm produce films that can be hydrated to the extent of 90%, are preferred embodiments of this invention.

FIG. 1 is a schematic of a submicroscopic view of a circular section 8 of a gel grafted-polymer particle film. The uniform low-Tg polymer particles 12 are surrounded by gelatin phase 14. The gelatin is grafted to the particles (less than 100 nm diameter) at points 16. The gelatin is cross linked at intersection points 18. In a dry state, the outer gelatin phase is glassy and the particle phase is rubbery, which results in a flexible film (unlike a 100% gelatin film, which is brittle). When swollen to contain about 90% water, the outer gelatin phase allows the diffusion of developer through the membrane (or film). Thus, such material does not cause inhibition of development as encountered in films containing equivalent high load of soft polymer particles.

Figure 2:
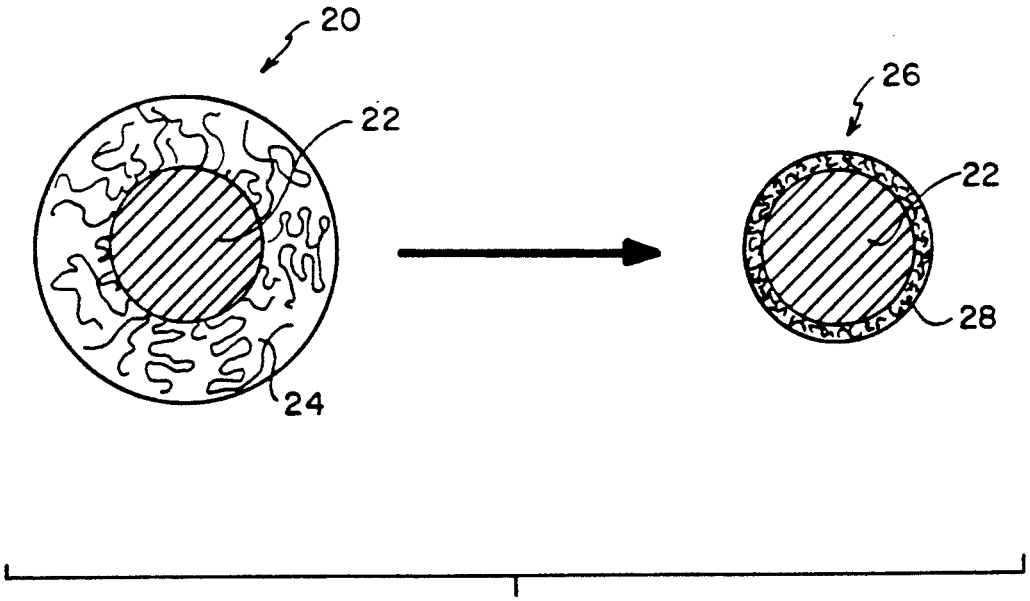

In a preferred embodiment, the monomolecular layer surrounding the gelatin grafted soft polymer particles can be further crosslinked to produce a thin hard shell (in dry coatings) by case hardening of the gelatin as indicated in FIG. 2 and as will be demonstrated by reduction to practice in the Examples. FIG. 2 shows that when extra gelatin hardener is added to an already gelatin-grafted soft polymer particle 20, with the core polymer particle 22 and a bonded monomolecular layer of gelatin 24, around it as described in (R-11 and R-12), hardening of the gelatin shell results, as there is no free gelatin left in solution, leading to case-hardened gelatin grafted soft polymer particle 26, having the same soft core particle 22 but with a hardened shell 28.

The photographic elements of the invention include those previously described in the art, for example, as disclosed at *Research Disclosure*, 308, p. 933–1014 (1989) (R-3) and at U.S. application Ser. No. 419,177, filed Oct. 10, 1989, entitled COLOR PHOTOGRAPHIC RECORDING MATERIAL The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be negative working or direct positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids are useful. Tabular grain light sensitive silver halides are particularly useful.

As employed herein the term "tabular grain emulsion" designates any emulsion in which at least 50 percent of the total grain projected area is accounted for by tabular grains. Whereas tabular grains have long been recognized to exist to some degree in conventional emulsions, only recently has the photographically advantageous role of the tabular grain shape been appreciated.

Tabular grain emulsions exhibiting particularly advantageous photographic properties include (i) high aspect ratio tabular grain silver halide emulsions and (ii) thin, intermediate aspect ratio tabular grain silver halide emulsions. High aspect ratio tabular grain emulsions are those in which the tabular grains exhibit an average aspect ratio of greater than 8:1. Thin, intermediate aspect ratio tabular grain emulsions are those in which the tabular grain emulsions of a thickness of less than 0.2 μm have an average aspect ratio in the range of from 5:1 to 8:1. Such emulsions are disclosed by Wilgus and et U.S. Pat. No. 4,434,226; Daubendiek et al U.S. Pat. No. 4,414,310; Wey U.S. Pat. No. 4,399,215; Solberg et al U.S. Pat. No. 4,433,048; Mignot U.S. Pat. No. 4,386,156; Evans et al U.S. Pat. No. 4,504,570; Maskasky U.S. Pat. No. 4,400,463, Wey et al U.S. Pat. No. 4,414,306, Maskasky U.S. Pat. Nos. 4,435,501 and 4,643,966, and Daubendiek et al U.S. Pat. Nos. 4,672,027 and 4,693,964. Also specifically contemplated are those silver bromoiodide grains with a higher molar proportion of iodide in the core than in the periphery of the grain, such as those described in G. B. 1,027,146; JA 54/48521; U.S. Pat. No.4,379,837; U.S. Pat. No. 4,444,877; U.S. Pat. No. 4,665,614; U.S. Pat. No. 4,636,461; EP 264,954; and U. K. patent application numbers 8916041.0 and 8916042.8, both filed 13 July 1989, and entitled PROCESS OF PREPARING A TABULAR GRAIN SILVER BROMOIODIDE EMULSION AND EMULSIONS PRODUCED THEREBY. The silver halide emulsions can be either monodisperse or polydisperse as precipitated. The grain size distribution of the emulsions can be controlled by techniques of separation and blending of silver halide grains of different types and sizes, including tabular grains, as previously described in the art, for example, in U.S. application Ser. No. 172,925, filed Mar. 25, 1988, entitled BLENDED EMULSIONS EXHIBITING IMPROVED SPEED-GRANULARITY RELATIONSHIPS.

The common feature of high aspect ratio and thin, intermediate aspect ratio tabular grain emulsions, hereinafter collectively referred to as "recent tabular grain emulsions", is that tabular grain thickness is reduced in relation to the equivalent circular diameter of the tabular grains. Most of the recent& tabular grain emulsions can be differentiated from those known in the art for many years by the following relationship:

$$ECD/t^2 > 25 \quad (1)$$

where

ECD is the average equivalent circular diameter of the tabular grains and t is the average thickness of the tabular grains. The term "equivalent circular diameter" is employed in its art recognized sense to indicate the diameter of a circle having an area equal to that of the projected area of a grain, in this instance a tabular grain. All tabular grain averages referred to are to be understood to be number averages, except as otherwise indicated.

Since the average aspect ratio of a tabular grain emulsion satisfies relationship (2):

$$AR = ECD/t \quad (2)$$

where

AR is the average tabular grain aspect ratio and

ECD and t are as previously defined, it is apparent that relationship (1) can be alternatively written as relationship (3):

$$AR/t > 25 \quad (3)$$

Relationship (3) makes plain the importance of both average aspect ratios and average thicknesses of tabular grains in arriving at preferred tabular grain emulsions having the most desirable photographic properties.

The illustrations of recent tabular grain emulsions satisfying relationships (1) and (3) are given in (R-3).

(R-3) requires precipitation of the tabular grains in the presence of a peptizer continuous phase which can be an acrylate or methacrylate polymer modified by the inclusion of thioether pendant groups. (R-3) also discloses vehicles particularly adapted for photothermography. It also discloses the use of "oxidized" (low methionine) gelatin as a peptizer. Otherwise, the emulsion layer vehicles are identical to those taught to be generally useful in preparing silver halide emulsion layers.

The recent tabular grain emulsions have been observed to provide a large variety of photographic advantages, including, but not limited to, improved speed-granularity relationships, increased image sharpness, a capability for more rapid processing, increased covering power, reduced covering power loss at higher levels of forehardening, higher gamma for a given level of grain size dispersity, less image variance as a function of processing time and/or temperature variances, higher separations of blue and minus blue speeds, the capability of optimizing light transmission or reflectance as a function of grain thickness, and reduced susceptibility to background radiation damage in very high speed emulsions.

While the recent tabular grain emulsions have advanced the state of the art in almost every grain related parameter of significance in silver halide photography, one area of concern has been the susceptibility of tabular grain emulsions to vary in their photographic response as a function of the application of localized pressure on the grains. As might be intuitively predicted from the high proportion of less compact grain geometries in the recent tabular grain emulsions, pressure (e.g., kinking, bending, or localized stress) desensitization, a long standing concern in silver halide photography, is a continuing concern in photographic elements containing recent tabular grain emulsions.

It was recognized prior to the discovery of recent tabular grain emulsions that latices in general when incorporated into silver halide emulsion layers can contribute to reducing pressure desensitization. This teaching is illustrated in (R-4).

EXAMPLES

The following examples are intended to be illustrative and not exhaustive of the invention. Parts and percentages are by weight unless otherwise specified:

EXAMPLE 1

Preparation of Poly(styrene-co-methacrylic Acid-co-Divinyl Benzene) Particles [weight Ration 90/5/5] (Particle A)

Sodium chloride (2888 g), potassium dichromate (11 g), diethanolamine adipate (49.5 g), and Ludox AM colloidal Si02 particles (550 g) were sequentially added to 8690 g distilled water to form an aqueous solution. To this solution was added a mixture of styrene (5940 g), methacrylic acid (330 g), divinylbenzene (330 g), and 2,2'-azobis-(2,4-dimethylvaleronitrile) (69.3 g). This mixture was stirred vigorously for 2 minutes and &hen emulsified in a homogenizer at 5000 psi. The resulting emulsion was placed in a reaction vessel, which was sealed. The emulsion was heated to 50° C. while being stirred at 80 rpm and held at that temperature for approximately 20 hours. The mixture was then heated to 75° C. and held at that temperature for 3 hours, cooled to room temperature, and filtered through a double layer of cheese cloth. The polymer particles were then filtered out of the dispersion using a Buchner funnel with 230 grade filter paper and redispersed in a solution of 11.5 kg distilled water, 1200 g 50% sodium hydroxide, and 8.34 g sodium dodecyl sulfate, and stirred vigorously for 15 minutes. The polymer particles were filtered out using the same filter apparatus, redispersed in a solution of 11.66 kg distilled water and 600 g 50% sodium hydroxide, filtered out again, and washed with distilled water. The polymer particles had mean diameter of 6.4 μm.

This is not a preferred polymer particle of the invention but has been used to demonstrate that grafting chemistry used in this invention does indeed chemically bond amine-group containing protein molecules to the surface of particles that contain pendent carboxyl groups. Such large size particles were chosen as they are easy to centrifuge to remove any unbound soluble protein in the aqueous solution phase. The polymer particle of this example will be called Particle-A. Particle-A, as is indicated in the synthesis contain 90% styrene, 5% methacrylic acid and 5% divinyl benzene.

EXAMPLE 2

Attachment of a Protein to Polymer Particle-A of Example 1

In this demonstration of chemical attachment using the carbamoylonium grafting agent 15 tritium labeled bovine gamma globulin (BGG) has been used instead of gelatin as radioactive BGG which gelatin can be easily obtained commercially. Both BGG and gelatin are biological protein molecules and are hence polypeptides and both therefore contain amine and carboxylic acid groups. The former as indicated earlier is involved in the chemical grafting process to the particle when carbamoylonium grafting agent 15 is used. The difference between BGG and gelatin is that BGG is still structurally undenatured and gelatin is completely denatured and exists in random coil configuration in aqueous solution. In other words, the BGG sample still maintained its hydrogen bonded globular structure. The second advantage of using BGG is that such structured adsorbed protein molecules can be easily displaced from the surface by the addition of the surfactant sodium dodecyl sulfate (SDS). This is not possible in the case of denatured gelatin molecule as it adsorbs like a randomly coiled molecule with tails, trains, and loops rather than somewhat continuously like a globular protein. This property has been utilized to demonstrate chemical bonding, as only chemically unbound BGG can be displaced by the addition of SDS whereas chemically bonded gelatin molecules on a surface cannot be displaced by the addition of SDS easily.

A solution containing 5.29 g of water and 0.000232 mole of the carbamoylonium compound-15 1-(4-morpholinocarbonyl)-4-(2 sulfoethyl)pyridinium hydroxide, inner salt, was added to a mixture of 45.71 g of distilled water and 50 ml of a 4% suspension (pH 8.0) of Particle-A of Example 1. The resultant mixture had a pH of about 8.0. A portion of the above activated latex containing 100 mg of polymer (dry weight) was incubated at 60° C. temperature for 15 minutes. To the incubated solution was added 100 mg of labeled (tritated) bovine gamma globulin ($^3$H BGG) solution of pH=8. The mixture was brought to a final volume of 30 ml with NaOH solution at pH=8.0 in a 50 ml centrifuge tube. The grafting reaction was continued for another 15 minutes at 60° C. with end-over-end rotation at 30–35 rpm while attached to a rotating plate mounted at a 45° angle.

A second experiment was done exactly in the same manner as above except no grafting agent was added.

The total amount of protein was determined by measuring: (a) the total cpm (counts per minute) in a 1 ml aliquot of the reaction mixture, (b) the cpm remaining in the supernatant following centrifugation of a 1 ml sample of the reaction mixture and (c) the cpm of the latex reagent following repeated washes of the pellet obtained in (b) after a first wash with water and then with 5% SDS solution. The quantity of the protein which was bound to the particles was calculated from knowing the specific surface area of the particles (0.94 $m^2/g$, computed from the particle diameter of 32 microns and the reasonable assumption of particle density to be equal to 1 g/ml). The results are tabulated in Table IV.

TABLE IV

| | Binding of $^3$H BGG to Particle A $^3$H BGG Bound in mg/sq m | |
|---|---|---|
| Sample | After washing with Distilled Water | After washing with 5% SDS Solution |
| Treated with Grafting Agent | 11.0 | 9.3 |
| Not Treated With Grafting Agent | 6.2 | 0.8 |

Figure 3:
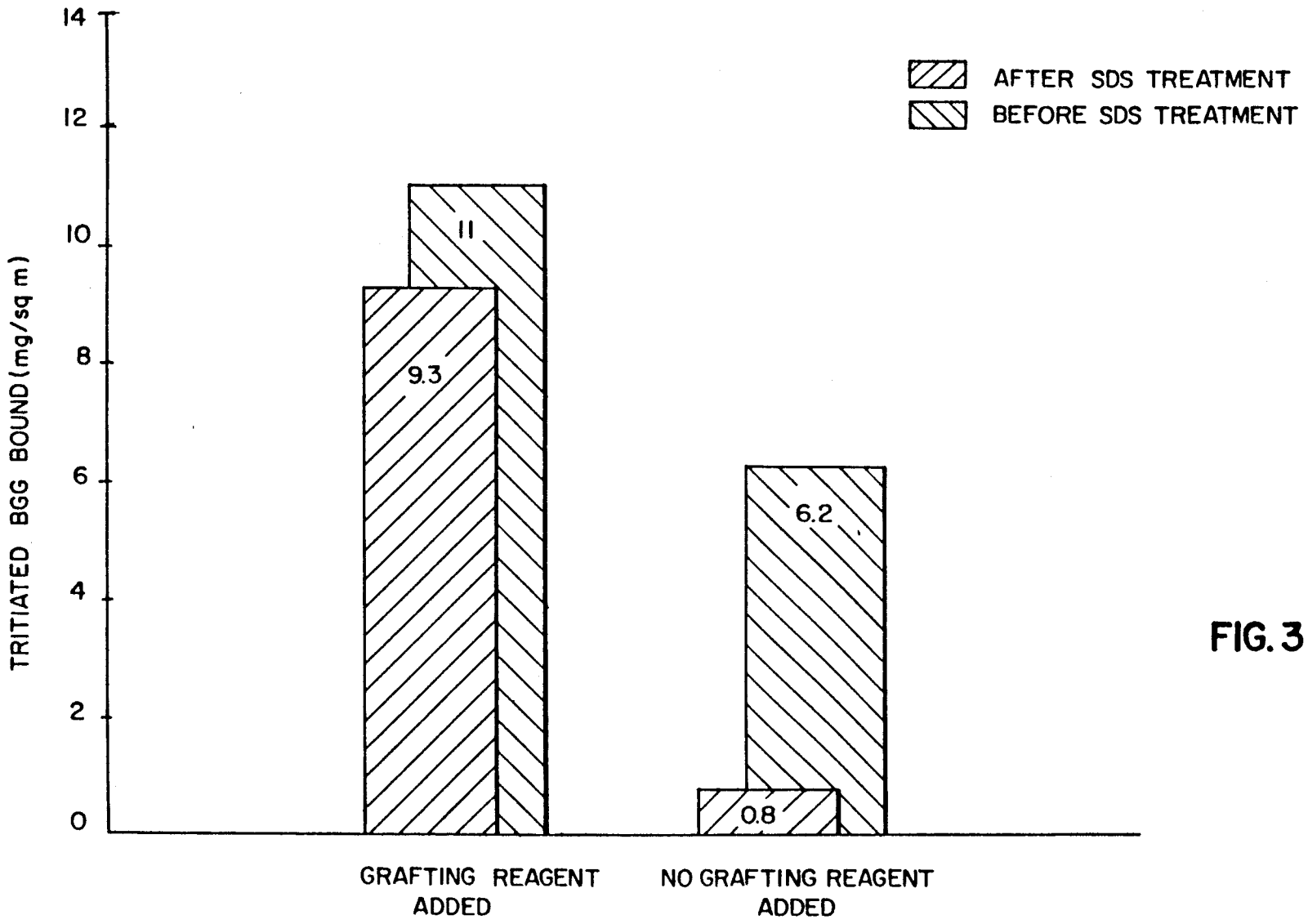
FIG. 3 shows binding of 3H BGG to polymer particle-A of Example-1 to demonstrate chemical grafting.

These results are also shown in FIG. 3. They indicate that in the case where grafting agent was not used, Just distilled water washed sample indicated a $^3$H BGG binding of 6.2 mg/sq m. This is indication of the fact that physically adsorbed BGG cannot be washed off the partile surface by washing with water but when washed with the SDS solution, most of the BGG was removed from being bound to the particle. In other words, with no grafting reagent the BGG was not chemically bound and was displaced by SDS. The sample that was treated with the grafting reagent, even the SDS solution wash was unable to remove the BGG from the particle surface. This tends to prove real chemical bond formation between the protein molecule and the particle surface in presence of the grafting agent and can be considered as evidence of chemical grafting.

EXAMPLE 3

Preparation of Poly(styrene-co-Butyl Acrylate-co-Meltracrylic Acid) Particles [weight Ratio 20/75/5] (Particle B)

The latex polymer of this example was prepared to determine optimal grafting conditions.

A 5l three-neck round bottom flask fitted with a condenser and a stirrer was charged with 3l of distilled water and heated to 60° C. The following were added to the flask after nitrogen purging for 10 minutes: · 6 g $K_2S_2O_8$ · 3 g $K_2S_2O_5$ · 6 g sodium dodecylsulfate (SDS)

The following monomers were mixed together and added to the flask:

| | |
|---|---|
| styrene | 60 g |
| butyl acrylate | 225 g |
| methacrylic acid | 15 g |

The reaction was carried out under nitrogen for 18 hours at 60° C. The resultant latex was filtered through glass wool and the solids were determined to be latex (in a stirred flask) and reaction carried out for another 15 minutes at 60° C. The gelatin attachment chemistry in these reactions were as follows:

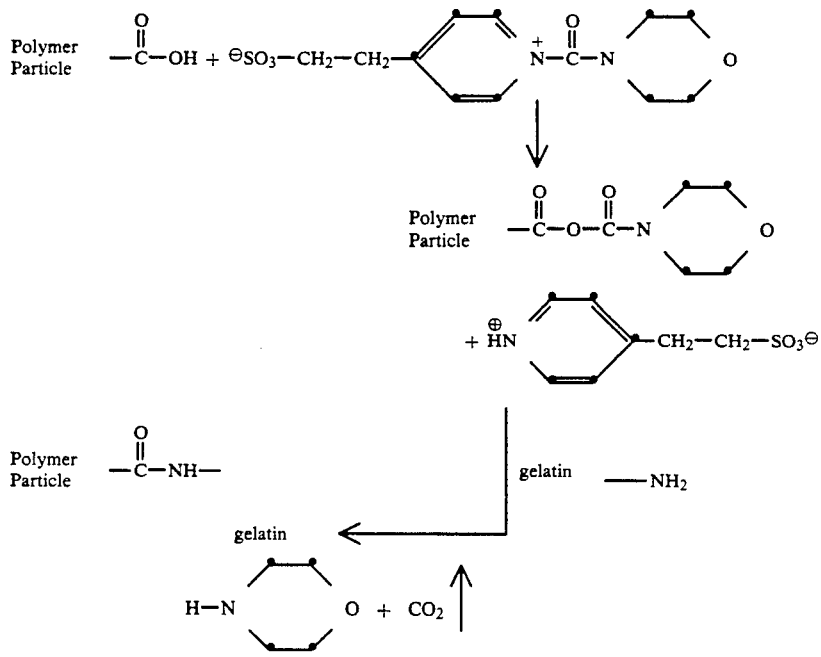

EXAMPLES 4 through 12

Grafting of Gelatin to Polymer Particle B of Example 3 to an Equal Dry Weight of Gelatin Using Various-Quantities of the Carbamoylonium Grafting Agent 15 for Definition of Grafting Conditions 5 Kg of a gelatin solution at 8.97% solids were prepared, heated to 60° C. and pH adjusted to 8.0. Gel g-latex samples (Examples 5 through 12) and one sample of gel mixed with latex (Example 4, Control) were prepared by the following general procedure. The various amounts of the carbamoylonium grafting agent 15 used are listed in Table V.

Figure 4:
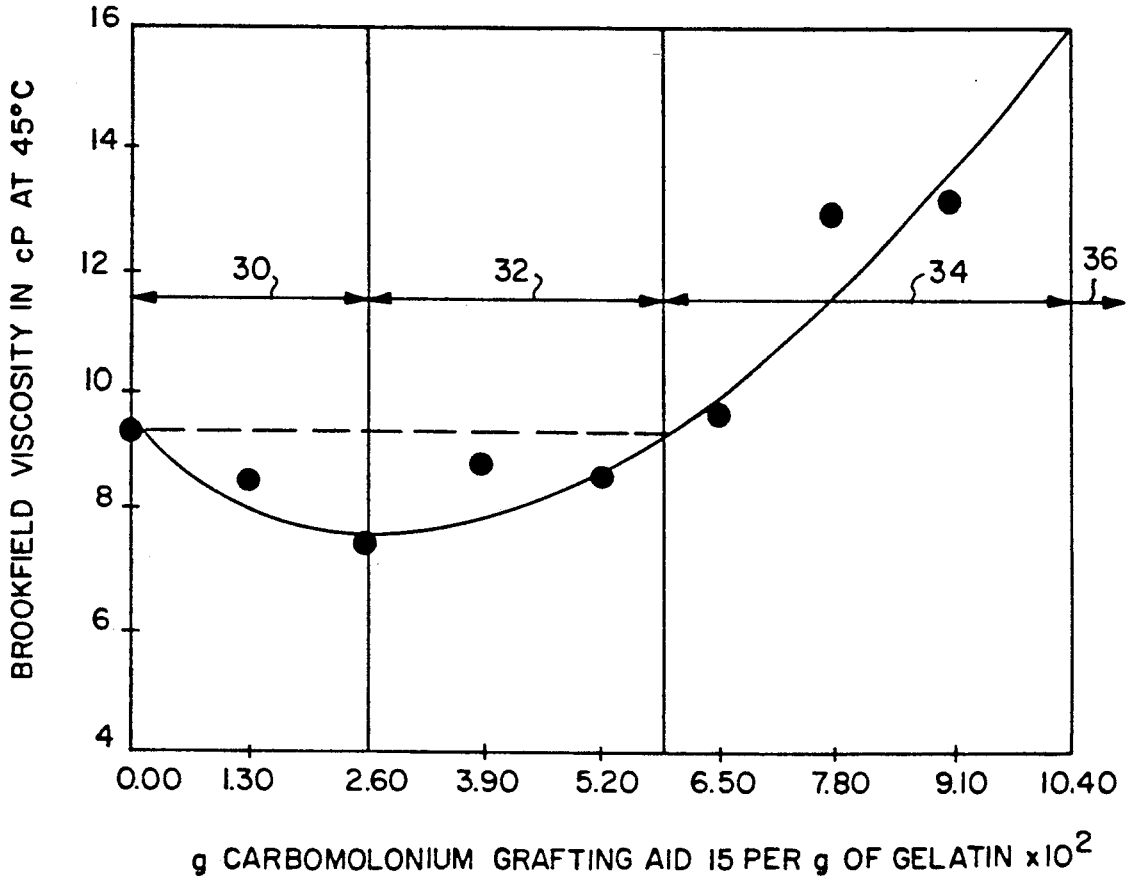
FIG. 4 shows viscosities of gel g-Latex Particle B [50% gelatin]at 45° C as a function of the amount of the carbamoylonium grafting agent used.

The samples were refrigerated and the viscosity of each of them were measured at 45° C. using a BROOKFIELD viscometer. The viscosity values are also listed in Table V. FIG. 4 shows a plot of the viscosities of the gel-g-Latex Particle-B samples as a function of the weight of the grafting agent used per g of gelatin. It is observed in FIG. 4, that the viscosity of the gel-g-Latex Particle-B as a function of the amount of the grafting agent goes through a shallow minimum at 2.60 g of grafting agent per g of gelatin. This is considered to be the optimum grafting condition. The viscosity of the dispersion is lowered up to this concentration as attachment of the gelatin molecules reduce the interaction

TABLE V

Preparation of Gel-g-Latex Particle B [50% Gelatin] Using Various Amounts the Carbamoylonium Grafting Agent 15 and Their Viscosities

| Example | g of 9.23% Latex Particle B Dispersion at 60° C. and pH = 8.0 | g of dry Polymer | g of 8.98% Gelatin Solution at 60° C. and pH = 8.0 | g of dry Gelatin | g of carbamoylonium Grafting Agent-15 | g of Grafting Agent per g of Gel ($\times 10^2$) | Brookfield Viscosity of gel-g Latex Samples cP at 45° C. |
|---|---|---|---|---|---|---|---|
| 4 Control | 500 | 46 | 513 | 46 | 0.00 | 0.00 | 9.32 |
| 5 | 500 | 46 | 513 | 46 | 0.60 | 1.30 | 8.46 |
| 6 | 500 | 46 | 513 | 46 | 1.20 | 2.60 | 7.38 |
| 7 | 500 | 46 | 513 | 46 | 1.80 | 3.90 | 8.72 |
| 8 | 500 | 46 | 513 | 46 | 2.40 | 5.20 | 8.51 |
| 9 | 500 | 46 | 513 | 46 | 3.00 | 6.50 | 9.51 |
| 10 | 500 | 46 | 513 | 46 | 3.60 | 7.80 | 12.82 |
| 11 | 500 | 46 | 513 | 46 | 4.20 | 9.10 | 13.03 |
| 12 | 500 | 46 | 513 | 46 | 4.80 | 10.40 | Cross-linked |

To 500 g of the dispersion of Latex Particle-B of Example 3 at 60° C. and pH 8.0 was added the amounts of grafting agent specified in Table V. The grafting agent was dissolved in 100 g of distilled water just prior to its addition to the latex. Reaction was carried out for 15 minutes at 60C with stirring and then 513 g of the gelatin solution at 60° C. and pH=8.0 was added to the between each other as they get chemically bonded to the particle surface. The regions marked 30 and 32 are thus considered to be the regions where the essential reaction is gelatin grafting to the surface of the polymer particles. Therefore, the range is between about $1.3 \times 10^{-2}$ g and about $6.0 \times 10^{-2}$ to obtain gelatin grafted particles. The increase of viscosity in the region 34 is considered to be due to partial chemical cross-linking between particles. At the higher end of this region where particle cross attachment is large, the material is not very useful. In region 36, beyond 10.40 g of the carbamoylonium grafting agent per g of gelatin, the gel-grafted particles are extremely highly cross attached to form an unmeltable gel and is not useful at all. Thus, these experimental boundaries define conditions for the preparation of useable gelatin grafted polymer particles.

EXAMPLE 13

Preparation of Poly(styrene-co-Butyl Acrylate-co-Methacrylic Acid) [Weight Ratio 38/38/24] (Particle C)

A 5 L three neck round bottom flask fitted with a condenser and an air stirrer was charged with 4 L of nitrogen purged distilled water and heated to 60° C. in a constant temperature bath. The following were added to the flask.

| | |
|---|---|
| Styrene | 152 g |
| Butyl acrylate | 152 g |
| Methacrylic acid | 96 g |
| Sodium dodecyl sulfate (SDS) | 0.4 g |
| $K_2S_2O_8$ | 2.0 g |
| $K_2S_2O_5$ | 1.0 g |

The reaction was carried out under nitrogen for 20 hours at 60° C. The resulting latex was dialyzed against distilled water for 56 hours. Particle diameter of the latex was determined by Photon Correlation Spectroscopy to be 96 nm. The surface area of the sample is $3/\rho r$ (where $\rho$ is the density of the particles (assumed ~ 1.0 g/cc) and r is the particle radius), or about 62 $m^2/g$ of dry particles. Final latex dispersion isolated was 4.11 kg @ 8.3% solids.

EXAMPLE 14

Grafting of Gelatin to Polymer Particle C of Example 13

4.11 Kg of the dispersion of Latex Particle C of Example 13 was placed in a 12l 3 neck round bottom flask fitted with a condenser and an air stirrer. The pH was adjusted to 8.0 with 20% NaOH solution. At the rate of 8.3% solids, the amount of polymer in the reactor was 4110×0.0833 g=341 g. The saturation adsorption of gelatin on surface is of the order of 10 mg per $m^2$ at pH around 8.0 (R-29). Therefore dry gel needed to obtain about 75% surface coverage, such that no gelatin is left free in solution for 4.11 Kg of the dispersion (=341 g of latex x 62 $m^2/g$ surface area of latex x 0.010 $g/m^2$ of gel for saturation adsorption x 0.75) is equal to 158 g of dry gelatin. The amount of carbamoylonium grafting agent 15 used was $2.5 \times 10^{-2}$ g per g of gelatin (=4.1 g). According to FIG. 4, this is Just about the point of optimal grafting. The grafting agent was added to the latex dispersion at 60° C. and pH =8.0 and allowed to react for 15 minutes with stirring at 60° C. 158 g of dry gelatin was dissolved in 1640 g of distilled water and adjusted to 60° C. and pH=8.0. The gel solution was then added to the latex dispersion and allowed to react under stirring at 60° C. for another 15 minutes for the grafting reaction to take place as indicated earlier. The composite particles contained (158 × 100)/(158 + 341) = 32% gel in the total solid residue. Total solids of the dispersion was determined to be 8.5%.

EXAMPLES 5 through 17

Case Hardening of Gel-g-Latex Particle of Example 14 by the Addition of Extra Carbamoylonium Compound 15

Preparation of Examples 15, 16 and 17 were done as follows: 100 g of the gel g Latex Particle C of Example 14 was heated to 60° C. in a beaker and pH was adjusted to 8.0 by using dilute NaOH solution. Predetermined amounts of the carbamoylonium compound 15 in 10% aqueous solutions (freshly prepared) was added to the gel g latex dispersions as indicated in Table VI and reaction carried out at 60° C. for 15 minutes. Each dispersion was dialyzed against distilled water for 18 hours at 45° C. to remove all salts. The pH of these dispersions was around 7.0. The hydrodynamic diameters of the particles with the grafted gelatin layers were determined by photon correlation spectroscopy (PCS). Results are shown in Table VI and FIG. 5. The PCS results indicate that as additional cross-linking agent is added, the gelatin layer thickeners of the chemically bonded gelatin shrinks because of case-hardening. Since there is no unbound gelatin in solution, the hardening agent goes to the surface bound gelatin layer and case-hardens it. Finally a 5 nm (50Å) thick hydrated bonded and case-hardened gelatin for gel grafting conditions that use between $5.20 \times 10^{-2}$ and $10.4 \times 10^{-2}$ g of the carbamoylonium grafting agent per g of gelatin, there is formed case hardened gelatin grafted polymer particles. The preferred range is between $5.2 \times 10^{-2}$ to about $9.10 \times 10^{-2}$ g of the carbamoylonium grafting agent per g of gelatin, to avoid particle to particle cross attachment. Such case hardening can also be achieved by any conventional gelatin hardener as listed in Table III.

TABLE VI

Case-Hardening of Gel-g-Latex Particle-C of Example-14 by Addition of Extra Carbamoylonium Compound-15

| Example | g of Carbamoylonium Grafting Agent Added/g of Gel in Composite × $10^2$ | Total g of Grafting Agent per g of Gel in Composite × $10^2$ | Hydrodynamic Diameter in nm by PCS | Grafted Gelatin Layer Thickness nm |
|---|---|---|---|---|
| 14 Control | 0.00 | 2.60 | 154 | 28 |
| 15 | 2.60 | 5.20 | 150 | 26 |
| 16 | 5.20 | 7.80 | 108 | 5 |
| 17 | 7.80 | 10.40 | 108 | 5 |

Hydrodynamic Diameter of Bare Latex C = 98 nm. Grafted and case-hardened gelatin layer thickness for example in Example 17 = (108 − 98)/2 = 5 nm

EXAMPLE 18

Preparation of Poly(Butyl Acrylate-co-Methacrylic Acid) [Weight Ratio 95/5] (Particle-D)

A 22 L three neck round bottom flask fitted with a condenser and an air stirrer was charged with 16L of nitrogen purged distilled water and heated to 60° C. in a constant temperature bath. The following were added in the flask:

| | |
|---|---|
| Butyl acrylate | 1520 g |
| Methacrylic acid | 80 g |
| Sodium dodecyl sulfate | 32 g |
| $K_2S_2O_8$ | 32 g |
| $K_2S_2O_5$ | 16 g |

The reaction was carried out under nitrogen for 20 hours at 60° C. Four batches of such latex dispersion were prepared and mixed together. Particle diameter of the mixed batch (Particle-D) as determined by PCS was around 53 nm. Thus was produced about 70 kg of latex at 9.7% solids. The pH of the latex was adjusted to 8.0 using 20% NaOH solution.

EXAMPLE 19

Preparation of Gel-g-Latex Particle D (of Example 18) [50% Gelatin]

30 kg of the dispersion of latex particle D at 9.7% solids and pH=8 was placed in a 10 gallon glass lined reactor fitted with air driven stirrer, a condenser and a nitrogen supply. The reaction temperature was raised to 60° C. and 105 g of the carbamoylonium grafting agent 15 was added. Reaction was carried out with the stirrer at 20 rpm for 20 minutes. In the meantime, in another similar reactor 3.0 kg of dry ossein gelatin was added to 27 kg of distilled water. Temperature was raised to 60° C. and gel was dissolved and pH was adjusted to 8.0 using 20% NaOH solution. After 20 minutes of reaction in the first reactor of the latex with the grafting agent was added the gelatin solution at 60° C. and the grafting reaction carried out at 60° C. for 20 minutes.

Figure 5:
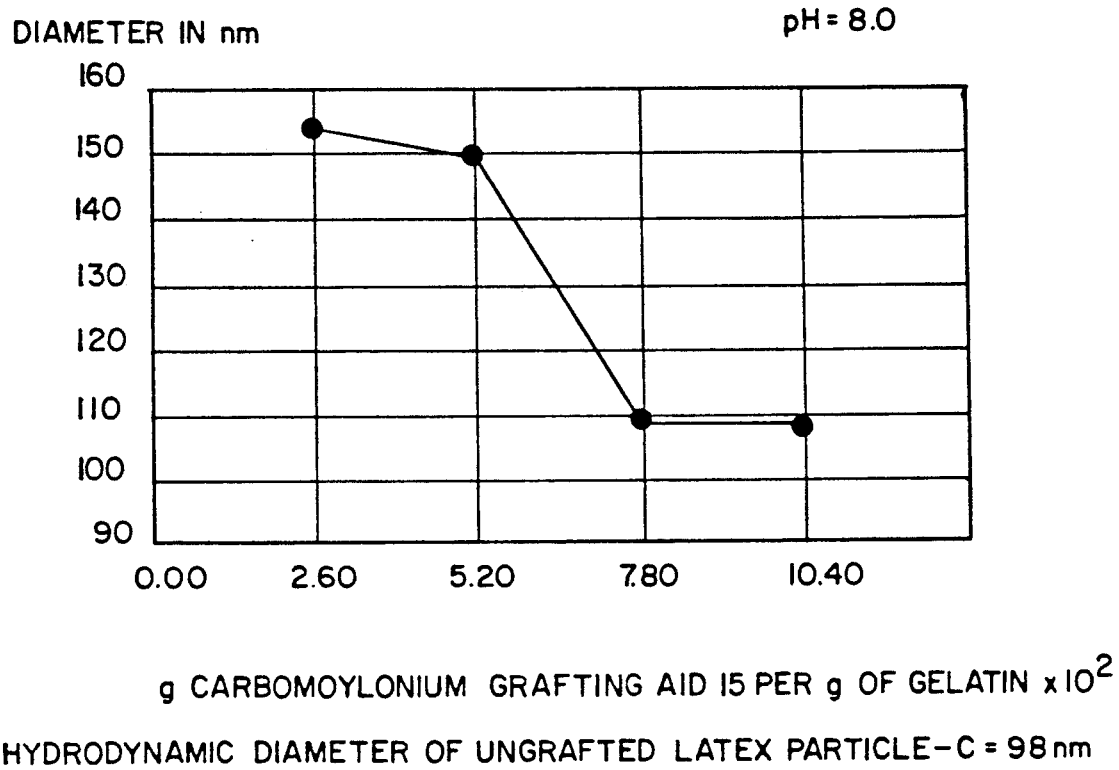
FIG. 5 shows case-hardening of gelatin grafted polymer particles.

The gel-g-latex was then diafiltered for 3 turnovers using 20,000 molecular weight cutoff spirally wound (4 ½ inch ×36 inch) Osmonics diafiltration cartidge in an associated diafiltration system to remove soluble reaction byproducts. The material was then concentrated to 21.4% solids. It is to be noted that &his material has approximately equal weight of gel and latex and thus was called Gel-g-Latex Particle-D [50% Gel]. Grams of the carbamoylonium grafting agent used per g of gelatin was 105/3000= 3.5%. According to FIG. 4, this amount falls in region 32 which is the region for grafting of gelatin to particle surfaces. The hydrodynamic diameters of the gel-g latex material was measured by PCS at pH=7 and was found to be 106 nm, which gives an adsorption layer thickness of (106-53)/2=26.5 nm. This is of the order of the value we get for the uncase-hardened material as indicated in FIG. 5. Therefore, we call this material the uncase-hardened sample.

EXAMPLE 20

Preparation of Case-Hardened Gel-g-Latex Particle D (of Example 18) ]33% gelatin]

33.7 kg of the dispersion of latex particle D latex at 9.7% solids and pH=8.0 was placed in the 10 gallon glass lined reactor fitted with an air driven stirrer, a condenser and a nitrogen supply. The reactor temperature was raised to 60° C. and 118 g of the carbamoylonium grafting agent 15 was added. Reaction was carried out with the stirrer at 20 rpm for 20 minutes. In the meantime, in another similar reactor 17.0 kg of 10% gel solution (1.7 kg dry gel) was prepared at 60° C as described previously. The pH of the gel solution was adjusted to 8.0 using 20% NaOH. After 20 minutes reaction in the first reactor of the latex with the grafting agent, was added the gelatin solution at 60° C. and the grafting reaction carried out for 20 minutes at 60° C.

The resultant material was diafiltered for 3 turnovers using the same equipment as described earlier and concentrated to 13.4% solids. The ratio of gel to latex in this experiment was 1700 g gel per (33700 × 0.97=)32689 g of latex is of the order of 0.5. Therefore, of the total solids in the material 33% is gel. The ratio of the weight of the grafting agent and gel in this experiment was 118/1700=6.9%. According to FIG. 4, this amount falls in the region 34, which is the case-hardening region of the gel in the particle surface. The hydrodynamic diameter of the material was determined at pH=7 and was found to be 64 nm. This gives an adsorption layer thickness of (64-53)/2=5.5 nm. This is of the order of the value we get for case-hardened material as indicated in FIG. 5. Therefore, we call this material case-hardened.

PHOTOGRAPHIC EXAMPLE 21

A color photographic recording material (Sample A) of Table VII for color negative development was prepared by applying the following layers in the given sequence to a transparent support of cellulose triacetate. The quantities of silver halide are given in mg of silver per $ft^2$. The quantities in "(10)" are given in mg per $m^2$.All silver halide emulsions were stabilized with 2 grams of 4-hydroxy 6 methyl-1,3,3a,7-tetraazaindene per mole of silver.

TABLE VII

Influence of Protective Materials of Examples 19 and 20 on Pressure-fog

| Sample | Protective Material in mg per $ft^2$ (mg per $m^2$) | Pressure-fog (Blue density increase) | % Increase Over Fog Level |
|---|---|---|---|
| A (control) | none | 0.56 | +72% |
| B (comparative) | tricresylphosphate 100 (1075) | 0.37 | +47% |
| C (comparative) | tricresylphosphate 133 (1430) | 0.30 | +38% |
| D (comparative) | tricresylphosphate 200 (2150) | sample delaminates | |
| E (invention) | gel-grafted latex (preparative Example #19) 100 (1075) of latex | 0.29 | +37% |
| F (invention) | case-hardened gel-grafted latex (preparative Example #20) 133 (1430) of latex | 0.23 | +29% |

Layer 1 (Antihalation Layer) Black colloidal silver sol containing 22 mg (236 mg) of silver and 227 mg (2440 mg) gelatin.

Layer 2 (First Red Sensitive Layer) Red sensitized silver iodobromide emulsion (4 mol % iodide, average grain diameter 1.3 microns, average grain thickness 0.1 micron) at 32 mg (344 mg), red sensitized silver iodobromide emulsion (4 mol % iodide, average grain diameter 0.8 microns, average grain thickness 0.09 microns) at 33 mg (355 mg), cyan dye forming image coupler C-1 at 50 mg (538 mg), DIR compound D-1 at 4.8 mg (52 mg), BAR compound B 1 at 1.5 mg (16 mg), and cyan dye-forming masking coupler CM-1 at 6.3 mg (68 mg) with gelatin at 150 mg (1612 mg).

Layer 3 (Second Red-Sensitive Layer) Red sensitized silver iodobromide emulsion (4.1 mol % iodide, average grain diameter 2.2 microns, average grain thickness 0.08 microns) at 69 mg (642 mg), cyan dye-forming image coupler C 1 at 27 mg (290 mg), DIR compound D-1 at 1.0 mg (11 mg), and cyan dye-forming masking coupler CM-1 at 2.7 mg (29 mg) with gelatin at 107 mg (1150 mg).

Layer 4 (Interlayer) Oxidized developer scavenger S-1 at 5 mg (54 mg), and dye YD-1 at 8 mg (86 mg) with 60 mg (645 mg) of gelatin.

Layer 5 (First Green-Sensitive Layer) Green sensitized silver iodobromide emulsion (2.6 mol % iodide, average grain diameter 0.8 microns, average thickness 0.09 microns) at 32 mg (344 mg), green sensitized silver iodobromide emulsion (3 mol % iodide, average grain diameter 1.1 microns, average grain thickness 0.12 microns) at 16 mg (172 mg), magenta dye-forming image coupler M-1 at 28 mg), magenta dye-forming image coupler M-2 at 12 mg (129 mg), magenta dye forming masking coupler MM-1 at 6.4 mg (69 mg), DIR compound D-1 at 2.3 mg (25 mg) with gelatin at 108 mg (1161 mg).

Layer 6 (Second Green-Sensitive Layer) Green sensitized silver iodobromide emulsion (4 mol % iodide, average grain diameter 1.9 microns, average grain thickness 0.09 microns) at 60 mg (645 mg), magenta dye-forming image coupler M-1 at 7 mg (75 mg), magenta dye-forming image coupler M-2 at 3 mg (32 mg), magenta dye-forming masking coupler MM-1 at 1.6 mg (17 mg), DIR compound D-2 at 1.8 mg (19.3 mg) with gelatin at 90 mg (968 mg).

Layer 7 (Interlayer) Oxidized developer scavenger S-1 at 5 mg (54 mg), yellow colloidal silver at 2 mg (22 mg) with 60 mg (645 mg) of gelatin.

Layer 8 (First Blue-Sensitive Layer) Blue sensitized silver iodobromide emulsion (4 mol % iodide, average grain diameter 0.9 microns, average grain thickness 0.1 micron) at 40 mg (430 mg), yellow dye-forming image coupler Y-1 at 100 mg (1075 mg), DIR compound D 3 at 4.3 mg (46 mg), 2-propargylamino benzoxazole at 0.004 mg (0.043 mg) with gelatin at 150 mg (1612 mg).

Layer 9 (Second Blue-Sensitive Layer) Blue sensitized silver iodobromide emulsion (3 mol % iodide, average grain diameter 2.6 microns, average grain thickness 0.12 microns) at 60 mg (645 mg), yellow dye forming image coupler Y-1 at 40 mg (430 mg), DIR compound D-3 at 2.3 mg (25 mg), 2 propargylaminobenzoxazole at 0.004 mg (0.043 mg) with gelatin at 112 mg (1204 mg).

Layer 10 (Protective Layer 1) 90 mg (967 mg) of gelatin, 10 mg (108 mg) of dye UV-1, 11 mg (118 mg) of dye UV-2.

Layer 11 (Protective Layer 2) Unsensitized silver bromide Lippman emulsion at 10 mg (108 mg), anti matte polymethylmethacrylate beads at 2.3 mg (25 mg), gelatin at 66 mg (710 mg) with 2% by weight to total gelatin of conventional hardner 1.

Compounds M-1, M-2, and D-2 were used as emulsions containing tricresylphosphate; compounds C-1, Y-1, and D-3 were used as emulsions containing di-n butyl phthalate; while compound D-1 was used as an emulsion containing N-n-butyl acetanalide.

Additional photographic samples were prepared in a substantially analogous manner except that quantities of either comparative or inventive protective material were added to Protective Layer 1 as listed in Table VII.

The pressure sensitivity of these samples was tested by subjecting portions of each sample to 42 psi pressure in a roller apparatus fitted with a sandblasted hardened steel wheel. The indentations and ridges on the sandblasted wheel mimic the effect of dirt particles on, for example, camera transport mechanisms.

Both pressured and unpressured samples were exposed to white light through a grey wedge chart. These samples were then developed using a color negative process, the KODAK C-41 process, as described in the British Journal of Photography Annual of 1988, pp. 196–198 (KODAK is a trademark of the Eastman Kodak Company, U.S.A.) to afford substantially identical sensitometry.

The magnitude of the pressure effect was quantified by comparing the yellow Dmin density of an unpressured sample to that of a pressured sample. The increase in density observed with the pressured sample is the pressure fog. Smaller values of the pressure-fog are superior in that they indicate that a particular film composition is less susceptible to forming unsightly marks and blemishes due to imperfections in film transport apparatus. This results in improved quality for prints made from such a color negative film, by the use of the gelatin-grafted soft polymer particles of Example 19 and case-hardened gelatin-grafted soft polymer particles of Example 20 in the cushioning layer above the sensitized photographic layers. In an alternate embodiment such cushioning layer may be placed in any of the scavenging (interlayers) layers situated in between two different color recording layers.

C-1
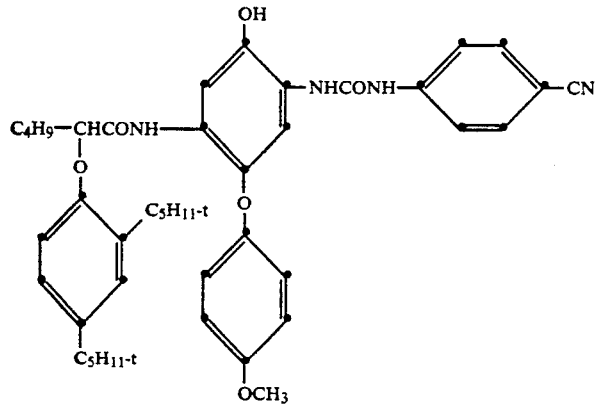
D-1
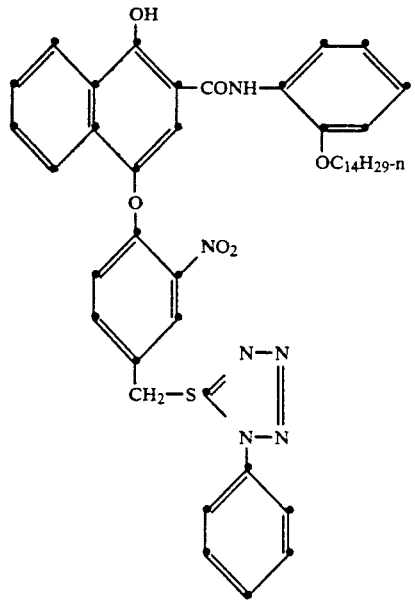
S-1
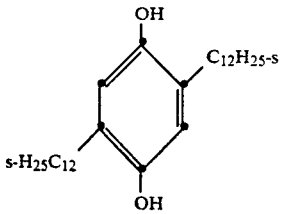
M-1
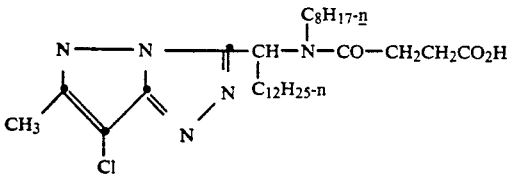
M-2
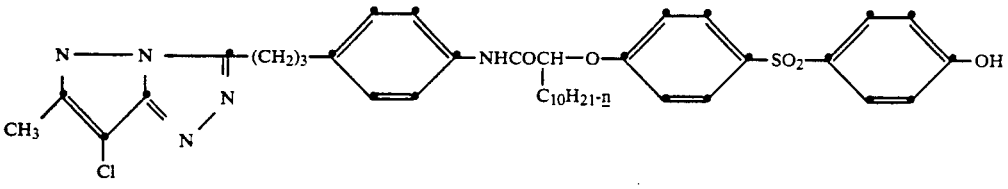

-continued
D-2
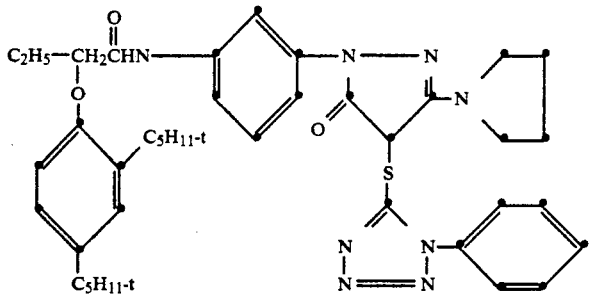
Y-1
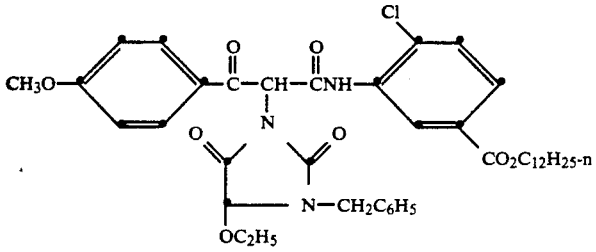
D-3
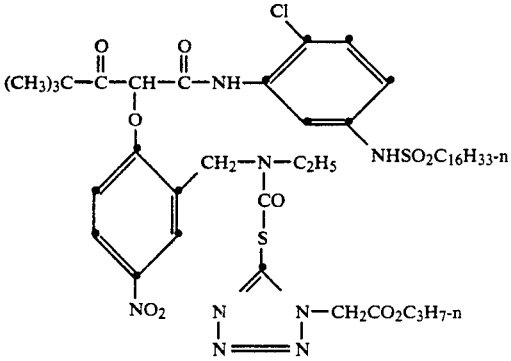
B-1
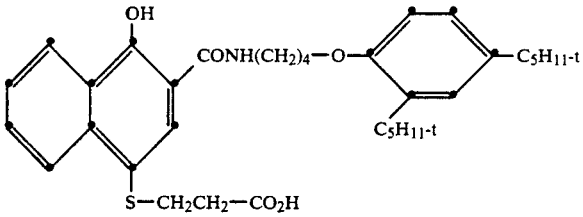
CM-1
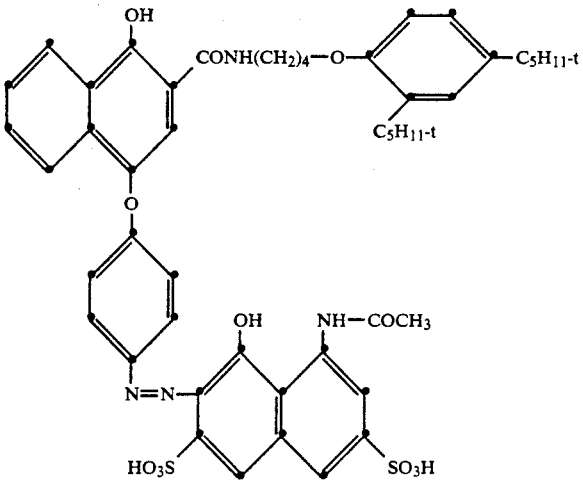

-continued

MM-1

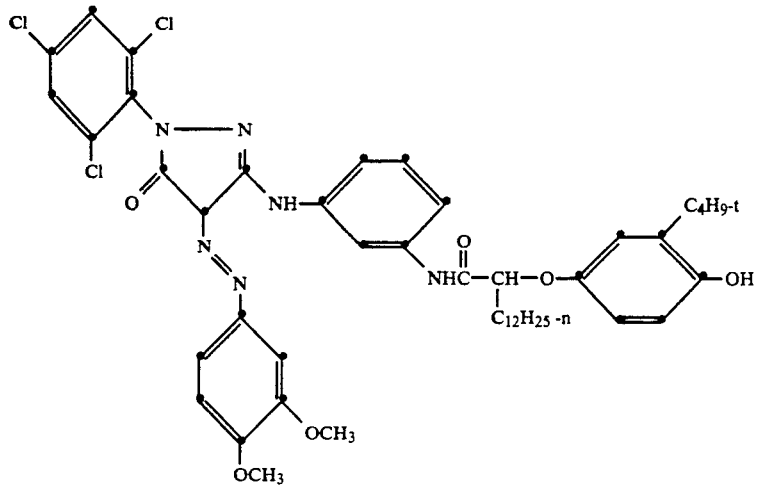

YD-1

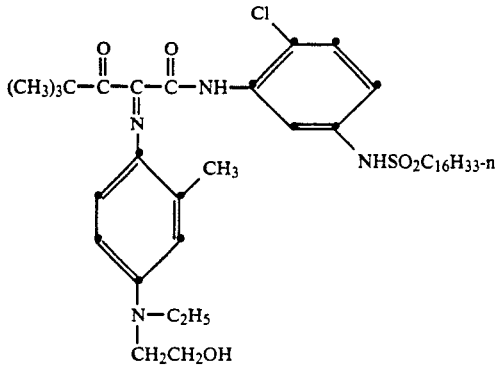

UV-1

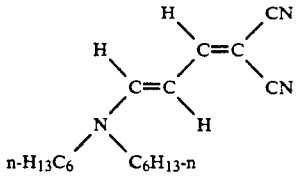

UV-2

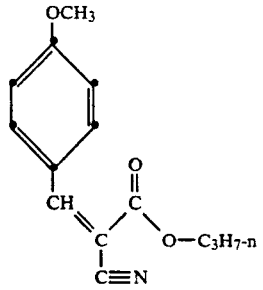

The invention has been described in detail with particular reference to preferred embodiments thereof, but it will be understood that variations and modifications can be effected within the spirit and scope of the invention.

We claim:

1. A substantially less pressure sensitive silver halide photographic film comprising at least one light sensitive silver halide element, and at least one cushioning layer, not containing photosensitive silver halide, incorporating composite particles comprising a soft polymer core having a mean diameter from about 10 nm to 500 nm covered with a layer of gelating shell that is chemically bonded to the soft polymer particle and cross-linked with a conventional hardener to form a hard case, whose thickness is less than 10 nm wherein said cushioning layer is situated in between two silver containing color recording layers of a multilayer color photographic product.

2. The element of claim 1 wherein the soft core polymer core has a glass transition temperature less than 25° C.

3. The element of claim 1 wherein the soft polymer core comprises of either butyl acrylate, ethyl acrylate, 2-ethylhexyl acrylate or propyl acrylate in weight percent from 40 to 98% of the total polymer.

4. The element of claim 1 wherein the soft polymer core contains at least 0.1 mole percent by weight of a monomer with at least one pendent carboxylic acid group.

5. The element of claim 1 wherein the soft polymer core contains at least 0.1 mole percent of methacrylic acid monomer.

6. The element of claim 1 wherein the soft polymer core is bonded to gelatin by a grafting agent selected from carbamoylonium compound, dication ethers and carbodiamide compounds.

7. The element of claim 1 wherein the soft polymer core is bonded to gelatin by using grafting agent 1-(4-morpholinocarbamoyl)-4-(2-sulfo- ethyl) pyridinium hydroxide inner salt.

8. The element of claim 1 wherein the soft polymeric material is derived from a polymer particle core capable of directly bonding to gelatin without a grafting agent.

9. The element of claim 1 wherein the soft polymer particle core is derived from a polymer that contains at least 0.1 mole percent by weight of monomers selected from monomers containing active halogen containing groups, aldehyde groups, azindine groups or isocyanate groups.

10. The element of claim 1 wherein the ratio of gelatin to the soft polymer particle core is between 1:2 and 2:1.

11. The element of claim 1 wherein said hardener is selected from bis(vinylsulfonylmethyl) ether, bis(vinylsulfonyl) methane or glutaraldehyde.

12. The element of claim 1 wherein the soft polymer core comprises butyl acrylate and methacrylic acid in the weight ratio of 95:5.

13. The element of claim 1 wherein the thickness of the element comprising case-hardened gelatin grafted soft polymer particles is less than 4 microns.

14. The element of claim 1 wherein said hard case is about 5 nm thick.

15. The element of claim 1 wherein the light sensitive silver halide element comprises a tabular grain emulsion.

16. A substantially less pressure sensitive silver halide photographic film element comprising at least one light sensitive silver halide layer a gelatin overcoat surface layer and a non-photosensitive silver halide containing cushioning layer over the upper silver halide layer and under said gelatin overcoat, said cushioning layer incorporating composite particles comprising a soft polymer core having a mean diameter from about 10 nm to 500 nm covered with a shell of gelatin that is chemically bonded to the soft polymer particle and cross-linked with a conventional hardener to form a hard case whose thickness is less than 10 nm.

17. The element of claim 16 further comprising a cushioning layer comprising hard case particles situated in between two different silver containing color recording layers of a multilayer color photographic product.

18. The element of claim 16 wherein said soft polymer core is between 10 nm and 20 nm in diameter.

19. The element of claim 16 wherein said soft core has a glass transition temperature less than 25° C.

20. The element of claim 16 wherein said soft polymer core comprises of either butyl acrylate, ethyl acrylate, 2-ethylhexyl acrylate or propyl acrylate in weight percent from 40 to 98% of the total polymer.

21. The element of claim 16 wherein said soft polymer core contains at least 0.1 mole percent by weight of a monomer with at least one pendent carboxylic acid group.

22. The element of claim 16 wherein said soft polymer core contains at least 0.1 mole percent of methacrylic acid monomer.

23. The element of claim 16 wherein said soft polymer core is bonded to gelatin by a grafting agent selected from carbamoylonium compound, dication ethers and carbodiamide compounds.

24. The element of claim 16 wherein said soft polymer core is bonded to gelatin by using grafting agent -1(4-morpholinocarbamoyl)-4-(2-sulfoethyl) pyridinium hydroxide inner salt.

25. The element of claim 16 wherein said soft polymer core is derived from a polymer particle capable of directly bonding to gelatin without a grafting agent.

26. The element of claim 16 wherein said soft polymer core is derived from a polymer that contains at least 0.1 mole percent by weight of monomers selected from monomers containing active halogen containing groups, aldehyde groups, azindine groups or isocyanate groups.

27. The element of claim 16 wherein the case-hardening agent is selected from bis(vinylsulfonylmethyl) ether, bis(vinylsulfonyl) methane or glutaraldehyde.

28. The element of claim 16 wherein said soft polymer core comprises butyl acrylate and methacrylic acid in the weight ratio of 95:5.

29. The element of claim 16 wherein the thickness of the element comprising case-hardened gelatin grafted soft polymer particles is less than 4 microns.

30. The element of claim 1 wherein the light sensitive silver halide element comprises a tabular grain emulsion.

31. The element of claim 16 wherein said hard case is about 5 nm in thickness.

* * * * *